US011185862B2

(12) United States Patent
Gach et al.

(10) Patent No.: US 11,185,862 B2
(45) Date of Patent: Nov. 30, 2021

(54) DIGITAL MICROFLUIDIC SYSTEMS WITH ELECTRODE BUS AND METHODS FOR DROPLET MANIPULATION

(71) Applicant: National Technology & Engineering Solutions of Sandia, LLC, Albuquerque, NM (US)

(72) Inventors: Philip Gach, Kensington, CA (US); Anup Singh, Danville, CA (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 121 days.

(21) Appl. No.: 16/177,173

(22) Filed: Oct. 31, 2018

(65) Prior Publication Data

US 2019/0126280 A1 May 2, 2019

Related U.S. Application Data

(60) Provisional application No. 62/579,423, filed on Oct. 31, 2017.

(51) Int. Cl.
*B01L 3/00* (2006.01)

(52) U.S. Cl.
CPC ..... *B01L 3/502792* (2013.01); *B01L 3/5088* (2013.01); *B01L 3/50273* (2013.01); (Continued)

(58) Field of Classification Search
CPC ..... B01L 3/502792; B01L 3/5088; B01L 2300/0645
See application file for complete search history.

(56) References Cited

U.S. PATENT DOCUMENTS

2007/0023292 A1 2/2007 Kim et al.
2010/0025242 A1 2/2010 Pamula et al.
(Continued)

FOREIGN PATENT DOCUMENTS

WO 2016/065365 A1 4/2016

OTHER PUBLICATIONS

J-W Chang, Integrated Fluidic-Chip Co-Design Methodology for Digital Microfluidic Biochips, IEEE Transactions on Computer-aided of Integrated Circuits and Systems, 2013(32), p. 216-227. (Year: 2013).*

*Primary Examiner* — Luan V Van
*Assistant Examiner* — Caitlyn Mingyun Sun
(74) *Attorney, Agent, or Firm* — Kilpatrick Townsend & Stockton LLP

(57) ABSTRACT

The present disclosure relates to digital microfluidic systems having an electrode bus controlled by a single actuation input, and methods for droplet manipulation using the electrode bus. Particularly, aspects are directed to a digital microfluidic system including a first group of droplet actuation electrodes formed in a substrate, a first wiring bus formed in the substrate and connected to each electrode in the first group of droplet actuation electrodes, and a first single point of actuation connected to the first wiring bus; and a second group of droplet actuation electrodes formed in the substrate, a second wiring bus formed in the substrate and connected to each electrode in the second group of droplet actuation electrodes, and a second single point of actuation connected to the second wiring bus.

10 Claims, 15 Drawing Sheets

(52) U.S. Cl.
CPC ... *B01L 3/502707* (2013.01); *B01L 3/502715* (2013.01); *B01L 2300/0887* (2013.01); *B01L 2300/161* (2013.01)

(56) References Cited

U.S. PATENT DOCUMENTS

2010/0025250 A1* 2/2010 Pamula ..... B01L 3/50273 204/660
2010/0236929 A1* 9/2010 Pollack ..... B01L 3/50273 204/450
2016/0116438 A1* 4/2016 Pamula ..... G01N 27/44791 204/454

* cited by examiner

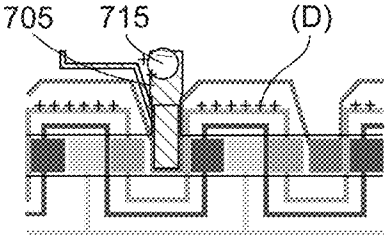
FIG. 7A
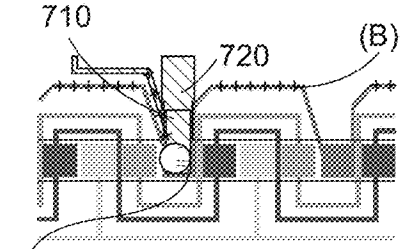
FIG. 7B
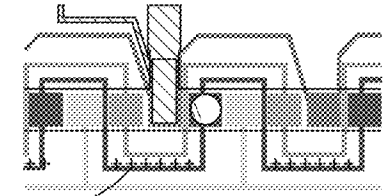
FIG. 7C
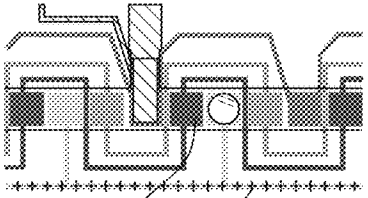
FIG. 7D
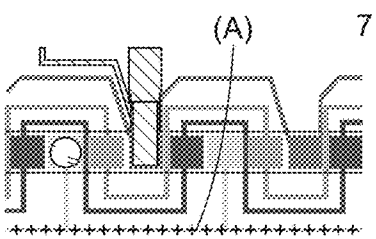
FIG. 7E
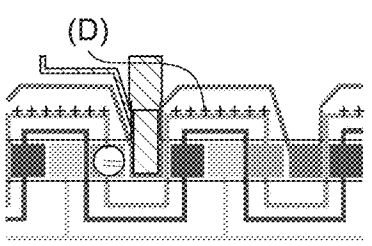
FIG. 7F
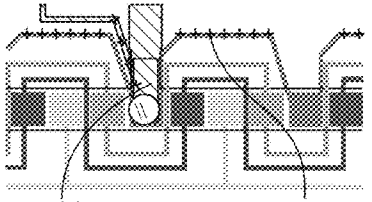
FIG. 7G
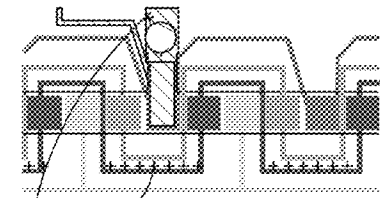
FIG. 7H
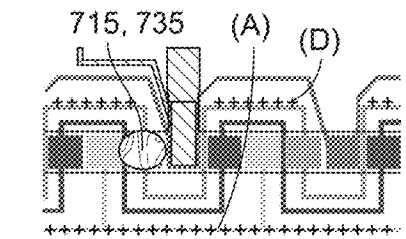
FIG. 7I
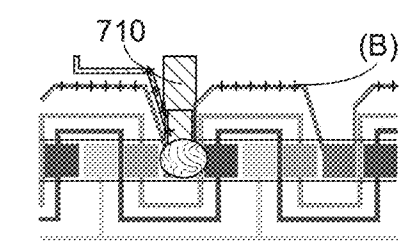
FIG. 7J
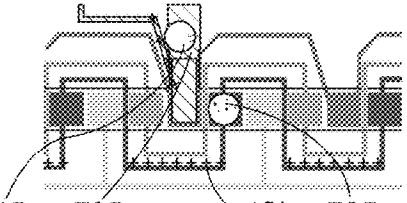
FIG. 7K
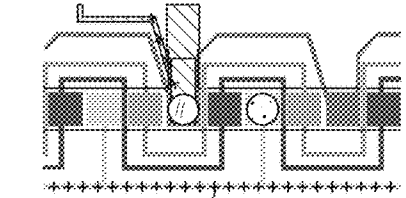
FIG. 7L
FIG. 7M
FIG. 7N
FIG. 7O
FIG. 7P

DIGITAL MICROFLUIDIC SYSTEMS WITH ELECTRODE BUS AND METHODS FOR DROPLET MANIPULATION

CROSS-REFERENCE TO RELATED APPLICATIONS

This application claims priority to U.S. Provisional Application No. 62/579,423 filed on Oct. 31, 2017, the entirety of which is incorporated herein by reference.

STATEMENT OF GOVERNMENT SUPPORT

The invention was made with government support under Contract Nos. DE-AC02-05CH11231 awarded by the U.S. Department of Energy. The government has certain rights in the invention

FIELD OF THE INVENTION

The present disclosure relates to digital microfluidic devices, systems, and methods for droplet manipulation, and in particular to digital microfluidic systems having an electrode bus controlled by a single actuation input, and methods for droplet manipulation using the electrode bus.

BACKGROUND

Digital microfluidics is a technology for microfluidic systems (e.g., lab-on-a-chip systems) based on the design, composition and manipulation of discrete droplets and/or bubbles. In digital microfluidic devices, electro-wetting-on-dielectric is a mechanism that may be used to dispense and manipulate droplets and/or bubbles. The electro-wetting-on-dielectric mechanism exploits electromechanical forces to control the droplets and/or bubbles. For example, in digital microfluidic devices having the electro-wetting-on-dielectric mechanism, the droplets and/or bubbles are actuated under wettability differences between actuated and nonactuated electrodes in order to dispense, transport, split, and merge the droplets and/or bubbles. The digital microfluidic devices can be used together with analytical analysis procedures such as mass spectrometry, colorimetry, electrochemical, and electrochemiluminescense to perform one or more analytical assays on the droplets and/or bubbles, for example identify a target antigen within the droplets and/or bubbles.

Digital microfluidic devices having the electro-wetting-on-dielectric (EWOD) mechanism typically include a droplet transport layer and an electrode layer. The droplet transport layer comprises a hydrophobic material to decrease the surface energy where the droplets and/or bubbles are in contact with a surface of the droplet transport layer. The electrode layer is a two dimensional planar substrate (e.g., a substrate having depth/width and length) that includes droplet actuation electrodes routed to peripheral electrical connections on a same horizontal plane of the substrate. An applied voltage activates the droplet actuation electrodes and allows changes in the wettability of the droplets and/or bubbles on the surface of the droplet transport layer. In order to move the droplets and/or bubbles, a control voltage may applied to a droplet actuation electrode adjacent to a droplet and/or bubble, and at the same time, a droplet actuation electrode just under the droplet and/or bubble is deactivated. By varying the electric potential along a linear array of droplet actuation electrodes, electro-wetting can be used to move the droplets and/or bubbles along the linear array of droplet actuation electrodes. These digital microfluidic devices are typically application specific with individually addressable droplet actuation electrodes. This makes the fabrication of the digital microfluidic devices simpler but limits the number of droplet actuation electrodes that can be arrayed because it is impractical to fit a large number of electrical connections together with the droplet actuation electrodes in a two dimensional planar substrate.

To increase the throughput or the quantity of achievable electrodes, electrode arrays have been built by a three dimensional process such as complementary metal-oxide-semiconductor (CMOS) and thin-film transistor (TFT) where the electrode layer is a three dimensional planar substrate (e.g., a substrate having depth/width, length, and height) that includes droplet actuation electrodes routed to peripheral electrical connections within a vertical plane of the substrate (i.e., the droplet actuation electrodes and the peripheral electrical connections are on different horizontal planes). Although the three dimensional processes increase the throughput or the quantity of achievable electrodes, the three dimensional processes such as CMOS and the TFT are considerably more complex and expensive, and the small size of transistors that result from such processes is not optimal for typical droplet sizes used in digital microfluidic devices. Consequently, the three dimensional microfluidic devices are not well suited for the majority of microfluidic applications in which inexpensive, disposable single or limited use analytical assay devices are desired. Accordingly, the need exists for relatively inexpensive, disposable single or limited use digital microfluidic devices, systems, and methods that include or utilize an increased throughput or quantity of achievable electrodes.

BRIEF SUMMARY

In various embodiments, a digital microfluidic system is provided for that includes: a substrate. The digital microfluidic system also includes a first group of droplet actuation electrodes formed in the substrate. The digital microfluidic system also includes a first wiring bus formed in the substrate and connected to each electrode in the first group of droplet actuation electrodes, where the first wiring bus is connected to a first single point of actuation. The digital microfluidic system also includes a second group of droplet actuation electrodes formed in the substrate. The digital microfluidic system also includes a second wiring bus formed in the substrate and connected to each electrode in the second group of droplet actuation electrodes, where the second wiring bus is connected to a second single point of actuation. The digital microfluidic system also includes a dielectric layer formed over the first group of droplet actuation electrodes and the second group of droplet actuation electrodes.

Implementations may include one or more of the following features. The digital microfluidic system where the first wiring bus and the second wiring bus run parallel to one another and are disposed within a same horizontal wiring layer of the substrate. The digital microfluidic system further including a channel formed above the first group of droplet actuation electrodes and the second group of droplet actuation electrodes, where the first wiring bus is formed in the substrate on a first side of the channel and the second wiring bus is formed in the substrate on a second side of the channel that is opposite the first side. The digital microfluidic system where the first single point of actuation a first control electrode and the second single point of actuation is a second control electrode. The digital microfluidic system where each electrode in the first group of droplet actuation electrodes is formed in an alternating pattern below the channel with each electrode in the second group of droplet actuation electrodes. The digital microfluidic system further including a hydrophobic layer formed on the dielectric layer. The digital microfluidic system where the substrate is an organic polymer substrate, an inorganic substrate, a semiconductor substrate or any combination thereof. For example, the substrate may comprise a printed circuit board (PCB), a flexible circuit board, a glass substrate, a fused silica substrate, polydimethylsiloxane (PDMS), a silicon substrate, a three dimensional printed substrate, a paper substrate, a polymer substrate or any combination thereof. The digital microfluidic system further including one or more individually addressable droplet actuation electrodes formed in the substrate, where each of the one or more individually addressable droplet actuation electrodes is connected to a different single point of actuation.

In various embodiments, a digital microfluidic system is provided for that includes: a top plate including: The digital microfluidic system also includes a first substrate. The digital microfluidic system also includes a first group of droplet actuation electrodes formed in the first substrate. The digital microfluidic system also includes a first wiring bus formed in the first substrate and connected to each electrode in the first group of droplet actuation electrodes, where the first wiring bus is connected to a first single point of actuation; a bottom plate including. The digital microfluidic system also includes a second substrate. The digital microfluidic system also includes a second group of droplet actuation electrodes formed in the second substrate. The digital microfluidic system also includes a second wiring bus formed in the second substrate and connected to each electrode in the second group of droplet actuation electrodes, where the second wiring bus is connected to a second single point of actuation. The digital microfluidic system also includes a channel formed between the first group of droplet actuation electrodes and the second group of droplet actuation electrodes.

Implementations may include one or more of the following features. The digital microfluidic system where the tope plate further includes a third group of droplet actuation electrodes formed in the first substrate; and a third wiring bus formed in the first substrate and connected to each electrode in the third group of droplet actuation electrodes, where the third wiring bus is connected to a third single point of actuation. The digital microfluidic system where the first wiring bus and the third wiring bus run parallel to one another and are disposed within a same horizontal wiring layer of the first substrate. The digital microfluidic system where the first wiring bus is formed in the first substrate on a first side of the channel and the third wiring bus is formed in the first substrate on a second side of the channel that is opposite the first side. The digital microfluidic system where each electrode in the first group of droplet actuation electrodes is formed in an alternating pattern above the channel with each electrode in the third group of droplet actuation electrodes. The digital microfluidic system where the bottom plate further includes a fourth group of droplet actuation electrodes formed in the second substrate; and a fourth wiring bus formed in the second substrate and connected to each electrode in the fourth group of droplet actuation electrodes, where the fourth wiring bus is connected to a fourth single point of actuation. The digital microfluidic system where the second wiring bus and the fourth wiring bus run parallel to one another and are disposed within a same horizontal wiring layer of the second substrate. The digital microfluidic system where the second wiring bus is formed in the second substrate on the first side of the channel and the fourth wiring bus is formed in the second substrate on the second side of the channel that is opposite the first side. The digital microfluidic system where each electrode in the second group of droplet actuation electrodes is formed in an alternating pattern below the channel with each electrode in the fourth group of droplet actuation electrodes. The digital microfluidic system where the top plate further includes a first dielectric layer formed over the first group of droplet actuation electrodes and a first hydrophobic layer formed on the first dielectric layer; and the bottom plate further includes a second dielectric layer formed over the second group of droplet actuation electrodes and a second hydrophobic layer formed on the second dielectric layer. The digital microfluidic system where the top plate or the bottom plate further includes one or more individually addressable droplet actuation electrodes formed in the first substrate or the second substrate, where each of the one or more individually addressable droplet actuation electrodes is connected to a different single point of actuation.

In various embodiments, a method of droplet manipulation is provided for that includes: obtaining a digital microfluidic system including: a first group of droplet actuation electrodes formed in a substrate, a first wiring bus formed in the substrate and connected to each electrode in the first group of droplet actuation electrodes, and a first single point of actuation connected to the first wiring bus; and a second group of droplet actuation electrodes formed in the substrate, a second wiring bus formed in the substrate and connected to each electrode in the second group of droplet actuation electrodes, and a second single point of actuation connected to the second wiring bus. The method of droplet manipulation also includes applying an electrical voltage to the first single point of actuation to actuate each electrode in the first group of droplet actuation electrodes, which allows changes in wettability of a droplet on or within the digital microfluidic system. The method of droplet manipulation also includes subsequently applying an electrical voltage to the second single point of actuation to actuate each electrode in the second group of droplet actuation electrodes, which allows changes in wettability of the droplet on or within the digital microfluidic system.

BRIEF DESCRIPTION OF THE DRAWINGS

The present invention will be better understood in view of the following non-limiting figures, in which:

FIGS. 7A-7P show different droplet manipulation techniques provided by a digital microfluidic system in accordance with various embodiments;

DETAILED DESCRIPTION

I. Introduction

Figure 1:
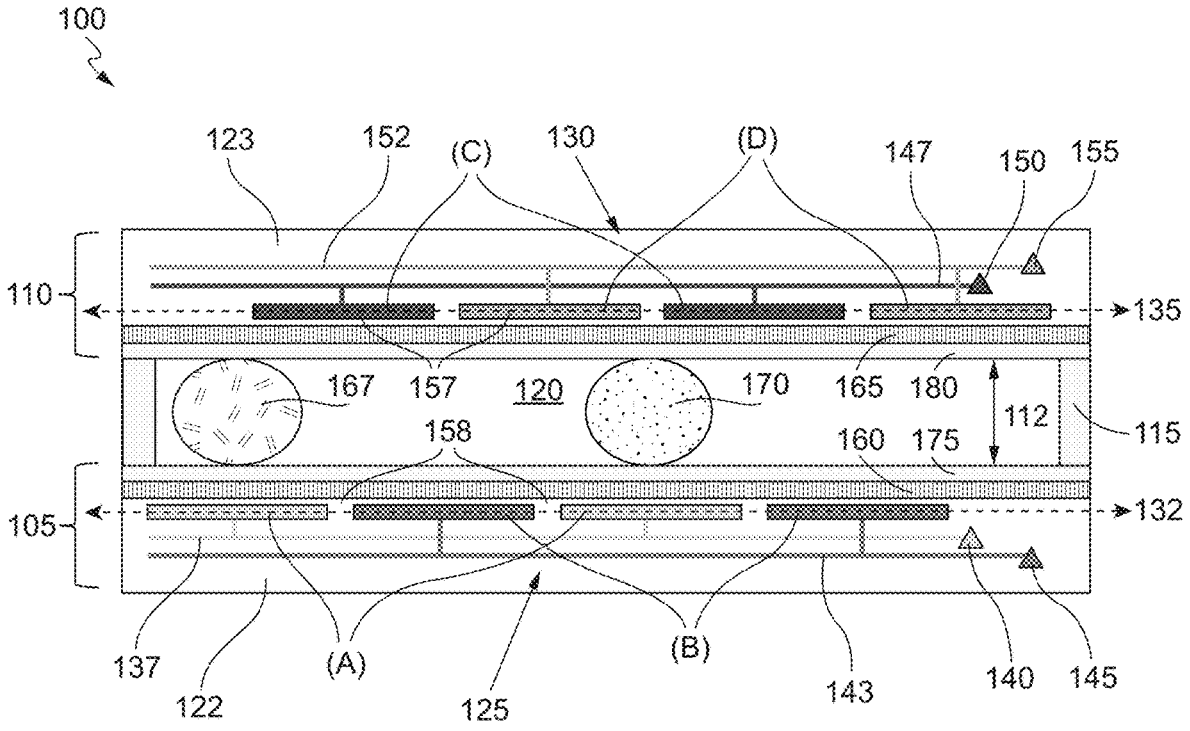
FIG. 1 shows a modified cross-sectional view of a digital microfluidic system in accordance with various embodiments.

The following disclosure describes digital microfluidic systems having an electrode bus controlled by a single actuation input, and methods for droplet manipulation using the electrode bus. In some embodiments, a digital microfluidic system is provided for that includes a bottom plate comprising a first array of droplet actuation electrodes disposed on a first substrate, and a top plate comprising a second array of droplet actuation electrodes disposed on a second substrate. Problems associated with conventional digital microfluidic systems, however, may include: (i) a limited number of droplet actuation electrodes that can be arrayed; (ii) small size transistors that are not optimal for typical droplet sizes used in digital microfluidic devices; and/or (iii) complex and expensive fabrication processes that are not well suited for the majority of microfluidic applications in which inexpensive, disposable single or limited use analytical assay devices are desired. These conventional digital microfluidic systems may be unable to assume greater design complexity with increased throughput or quantity of achievable electrodes while remaining relatively inexpensive such that the devices can be disposable or adequate for limited use.

In view of these problems, various embodiments disclosed herein are directed to techniques for manipulating droplets (e.g., dispense, transport, split, and merge droplets) on a droplet transport layer using minimal connections to an array of droplet actuation electrodes. In various embodiments, this is achieved by busing droplet actuation electrodes within an array such that groups of electrodes are controlled by a single actuation point. For example, a first array of droplet actuation electrodes may be formed on a first substrate of a bottom plate in an alternating pattern such that every other electrode is bused together and controlled by a single actuation input. In some embodiments, a second array of droplet actuation electrodes may be formed on a second substrate of a bottom plate in an alternating pattern such that every other electrode is bused together and controlled by a single actuation input. Following the addition of dielectric layers on both substrates and inclusion of a spacer, the top and bottom plates may be aligned and bound together to create a droplet transport layer or channel. The busing of the alternating patterns of electrodes creates a series of at least four groups of electrodes, two for the top substrate and two for the bottom substrate, which upon sequential actuation allow droplet manipulation within the droplet transport layer or channel and across the system. The droplet actuation electrodes may be actuated alternating from bottom to top and left to right with the OFF electrodes serving as ground. This droplet conveyance system of bused electrodes can be infinitely long but could also be presented in alternate geometries to enable other functionality such as droplet creation, mixing, splitting and merging. For example, individually addressable droplet actuation electrodes may be integrated with the bused droplet actuation electrodes to allow programmable or on-demand droplet manipulation.

The digital microfluidic systems discussed herein having an electrode bus controlled by a single actuation input are intended to be disposable or adequate for limited use, and may be fabricated and customized for specific application(s), using a variety of substrates (e.g., glass, organic or inorganic polymers, printed circuit boards (PCBs), paper, etc.). For example, one or more illustrative embodiments of a digital microfluidic system may include a substrate; a first group of droplet actuation electrodes formed in the substrate; a first wiring bus formed in the substrate and connected to each electrode in the first group of droplet actuation electrodes; a second group of droplet actuation electrodes formed in the substrate; a second wiring bus formed in the substrate and connected to each electrode in the second group of droplet actuation electrodes; and a dielectric layer formed over the first group of droplet actuation electrodes and the second group of droplet actuation electrodes. The first wiring bus may be connected to a first single point of actuation and the second wiring bus may be connected to a second single point of actuation. In some embodiments, the first wiring bus and the second wiring bus run parallel to one another and are disposed within a same horizontal wiring layer of the substrate. In certain embodiments, the digital microfluidic system further comprises a channel formed above or below the first group of droplet actuation electrodes and the second group of droplet actuation electrodes, and each electrode in the first group of droplet actuation electrodes is formed in an alternating pattern below the channel with each electrode in the second group of droplet actuation electrodes.

Advantageously, busing droplet actuation electrodes within an array such that groups of electrodes are controlled by a single actuation point in accordance with aspects discussed herein provides multiple benefits over conventional digital microfluidic systems including: (i) a minimal number of individually addressed droplet actuation electrodes, which reduces complexity of fabricated wiring layers, (ii) a programmable system having a low-cost and ability to be disposable, and (iii) low (10s) to moderate (100s) to very high-density (10,000-100,000s) electrode arrays that can be operated using minimal actuation connections. Specifically, these approaches can provide relatively inexpensive, disposable single or limited use digital microfluidic devices, systems, and methods that include or utilize an increased throughput or quantity of achievable electrodes.

II. Digital Microfluidic Devices and Systems with Variable Electrode Array

FIG. 1 shows a modified cross-sectional view of a digital microfluidic system 100 in accordance with various aspects of the present invention. In some embodiments, the digital microfluidic system 100 includes two plates 105 and 110 (i.e., a bottom plate and a top plate for a closed system) arranged in parallel to one another respectively with a distance gap 112 (e.g., maintained by one or more spacers 115) making up one or more fluidic channels 120. In other embodiments, the digital microfluidic system 100 includes only one plate 105 (i.e., only a bottom plate for an open system). The bottom plate 105 and the top plate 110 may comprise a first substrate 122 and a second substrate 123, respectively. The first substrate 122 and the second substrate 123 may be made of the same or different material such as glass or silicon. In certain embodiments, the first substrate 122 and the second substrate 123 are printed circuit board (PCB), a flexible circuit board, a glass substrate, a silicon substrate, a three dimensional printed substrate, a paper substrate, or any combination thereof. The bottom plate 105 may further comprise a patterned array of controllable electrodes 125 (a first array of droplet actuation electrodes) formed on the first substrate 122, and the top plate 110 may comprise a patterned array of controllable electrodes 130 (a first array of droplet actuation electrodes) formed on the second substrate 123. The electrodes (e.g., electrodes 125 and electrode 130) may be formed of any material, such as copper, graphite, titanium, brass, silver, gold, chromium, platinum, indium tin oxide (ITO), and any alloys thereof, that has the combined features of electrical conductivity, corrosion resistance, hardness, form, size, and optionally optical transparency. In certain embodiments, the array of electrodes 125 are provided on a same horizontal plane 132 of the bottom plate 105, and the array of electrodes 130 are provided on a same horizontal plane 135 of the top plate 110.

In various embodiments, the bottom plate 105 further includes a wiring bus 137 connected to a group of electrodes (A) (e.g., a group of alternating electrodes) from within the array of electrodes 125. The wiring bus 137 electrically connects the group of electrodes (A) together such that the group of electrodes (A) may be controlled by a single actuation point 140. The bottom plate 105 may further include a wiring bus 143 connected to a group of electrodes (B) (e.g., a group of alternating electrodes) from within the array of electrodes 125. The wiring bus 143 electrically connects the group of electrodes (B) together such that the group of electrodes (B) may be controlled by a single actuation point 145. In some embodiments, the top plate 110 further includes a wiring bus 147 connected to a group of electrodes (C) (e.g., a group of alternating electrodes) from within the array of electrodes 130. The wiring bus 147 electrically connects the group of electrodes (C) together such that the group of electrodes (C) may be controlled by a single actuation point 150. The top plate 110 may further include a wiring bus 152 connected to a group of electrodes (D) (e.g., a group of alternating electrodes) from within the array of electrodes 130. The wiring bus 152 electrically connects the group of electrodes (D) together such that the group of electrodes (D) may be controlled by a single actuation point 155.

Although wiring buses 137, 143, 147, 152 are depicted vertical of one another on separate horizontal planes, it should be understood that this depiction is merely for convenience of illustration (i.e., a modified cross-section view) and in actual implementation the wiring buses 137, 143 are on a same horizontal plane within the bottom plate 105 (as shown in FIGS. 3A-3D) running parallel to one another and the wiring buses 147, 152 are on a same horizontal plane within the top plate 110 (as shown in FIGS. 3A-3D) running parallel to one another such that the wiring buses 137, 143, 147, 152 can be formed using 2D fabrication processes. Each wiring bus 137, 143, 147, 152 provides an electrical connection between its respective group of electrodes (A), (B), (C), (D) and control circuitry so that each group of electrodes (A), (B), (C), (D) can be directly and independently electrically actuated. In certain embodiments, the group of electrodes (C), (D) are fabricated on the second substrate 123 such that the center 157 of each of the electrodes of the group of electrodes (C), (D) are shifted to align with open spaces 158 between each of the electrodes of the group of electrodes (A), (B). Consequently, in response to an electric voltage applied through each wiring bus 137, 143, 147, 152, a surface wettability of the driving surface in the vicinity of the actuated group of electrodes (A), (B), (C), (D) is modified. By properly actuating the group of electrodes (A), (B), (C), (D), one or more droplets may be manipulated (serially or simultaneously) by the digital microfluidic system 100 as required for the process being performed by the digital microfluidic system 100. For example, droplets may be created from a reservoir, moved, divided, and/or combined/mixed, as desired.

The bottom plate 105 and the top plate 110 may further comprise a first dielectric layer 160 and a second dielectric layer 165, respectively. The first dielectric layer 160 and the second dielectric layer 165 may be made of the same or different material such as parylene C, parylene AF4, polyimide, polytetrafluoroethylene (PTFE), polydimethylsiloxane (PDMS), SU-8 photoresist, silicon dioxide, or silicon nitride. If the material(s) of the first dielectric layer 160 and the second dielectric layer 165 exhibit suitable hydrophobic properties for EWOD, then the first dielectric layer 160 and the second dielectric layer 165 may be utilized as the driving surface of the digital microfluidic system 100. In other words, when the electric voltage is applied to the group of electrodes (A), (B), (C), (D), the surface wettability of the first dielectric layer 160 and the second dielectric layer 165 will become less hydrophobic (or will change from hydrophobic to hydrophilic, or will become more hydrophilic, as the case may be). As a result, a droplet and/or bubble 167, 170, or portions thereof, in the vicinity of the actuated group of electrodes (A), (B), (C), (D) will tend to be pulled toward the actuated group of electrodes (A), (B), (C), (D). For example, parylene C is hydrophobic and can be utilized as the driving surface. The droplet and/or bubble 167, 170 may comprise a sample (e.g., a biochemical, chemical, biological, etc. sample) and be contained in a filler medium, such as silicone oil or air, and may be sandwiched between the bottom plate 105 and the top plate 110 to facilitate the transportation of the droplet inside the one or more fluidic channels 120.

If the first dielectric layer 160 and the second dielectric layer 165 are not suitable for efficient electric operations, or in the instance that a better driving surface is desired, a first hydrophobic layer 175 and a second hydrophobic layer 180 may be disposed on the first dielectric layer 160 and the second dielectric layer 165, respectively, in order to improve the operational characteristics of the surface of the bottom plate 105 and top plate 110. Suitable materials for the first hydrophobic layer 175 and the second hydrophobic layer 180 include Teflon™ AF, Cytop® Rain-X®, Aquapel® superhydrophobic nanostructures, and other hydrophobic materials. The first hydrophobic layer 175 and the second hydrophobic layer 180 can be applied onto a surface of the first dielectric layer 160 and the second dielectric layer 165, respectively, by any suitable method, such as spin coating, or other deposition methods as known in the art. The first hydrophobic layer 175 and the second hydrophobic layer 180 may be added to the bottom plate 105 and/or the top plate 110 to provide a low friction against droplet movement or increase the wettability of the driving surface of each plate, and to add capacitance between the droplet and/or bubble 167, 170 and the electrodes. As such, other low-friction materials can substitute the hydrophobic material.

Figure 2A:
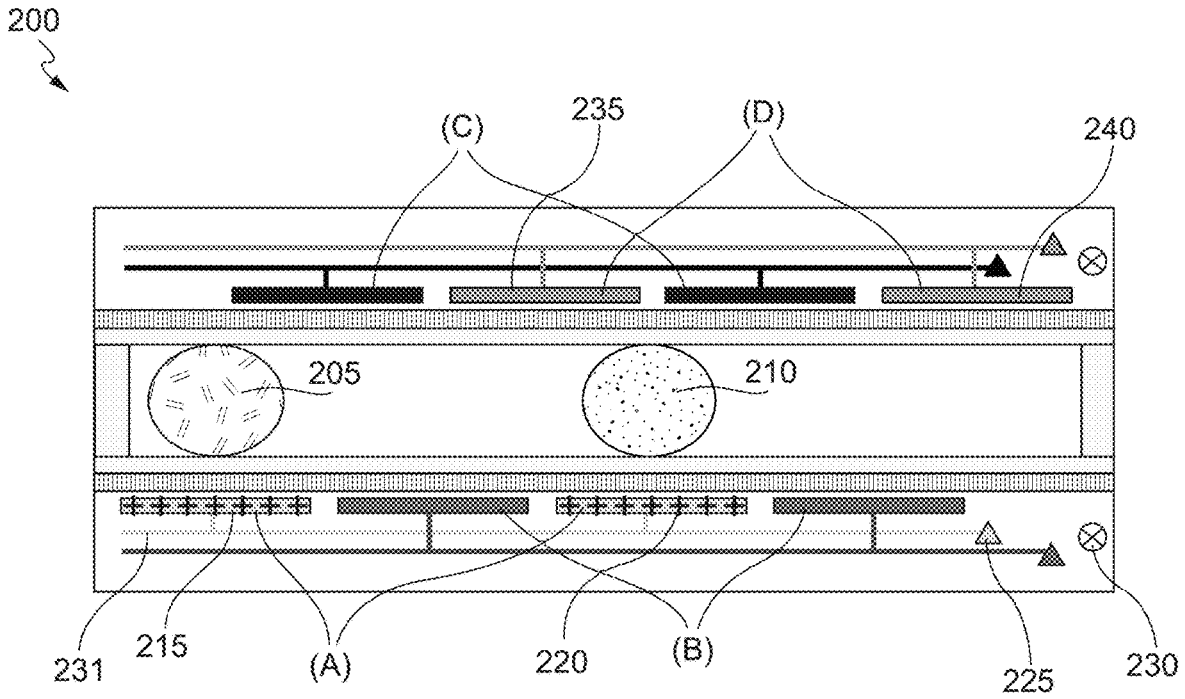
FIGS. 2A-2D show modified cross-sectional views of a digital microfluidic system for manipulation of droplet(s) in accordance with various embodiments.
Figure 2B:
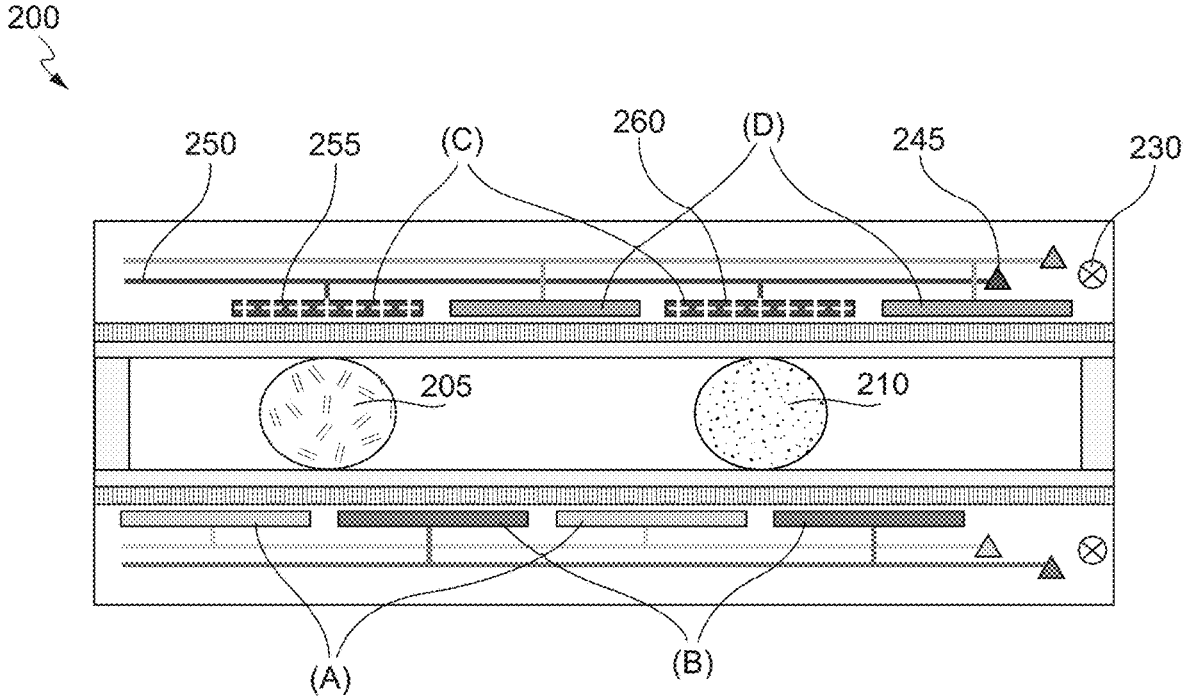
Figure 2C:
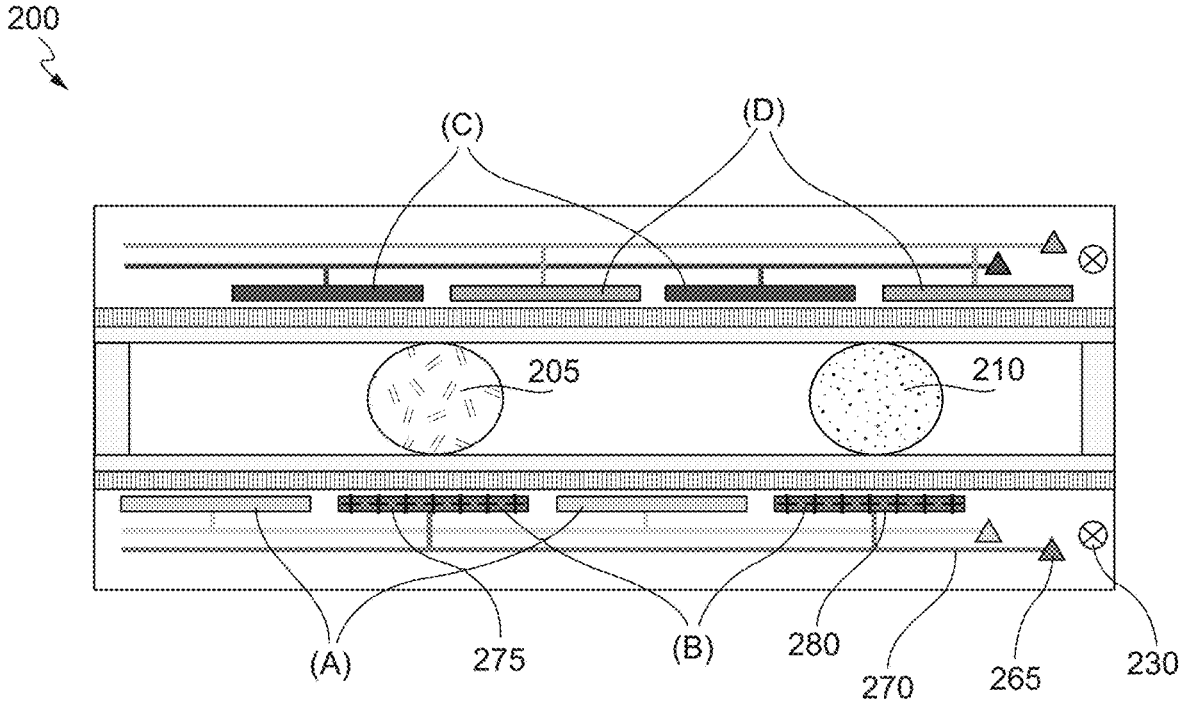
Figure 2D:
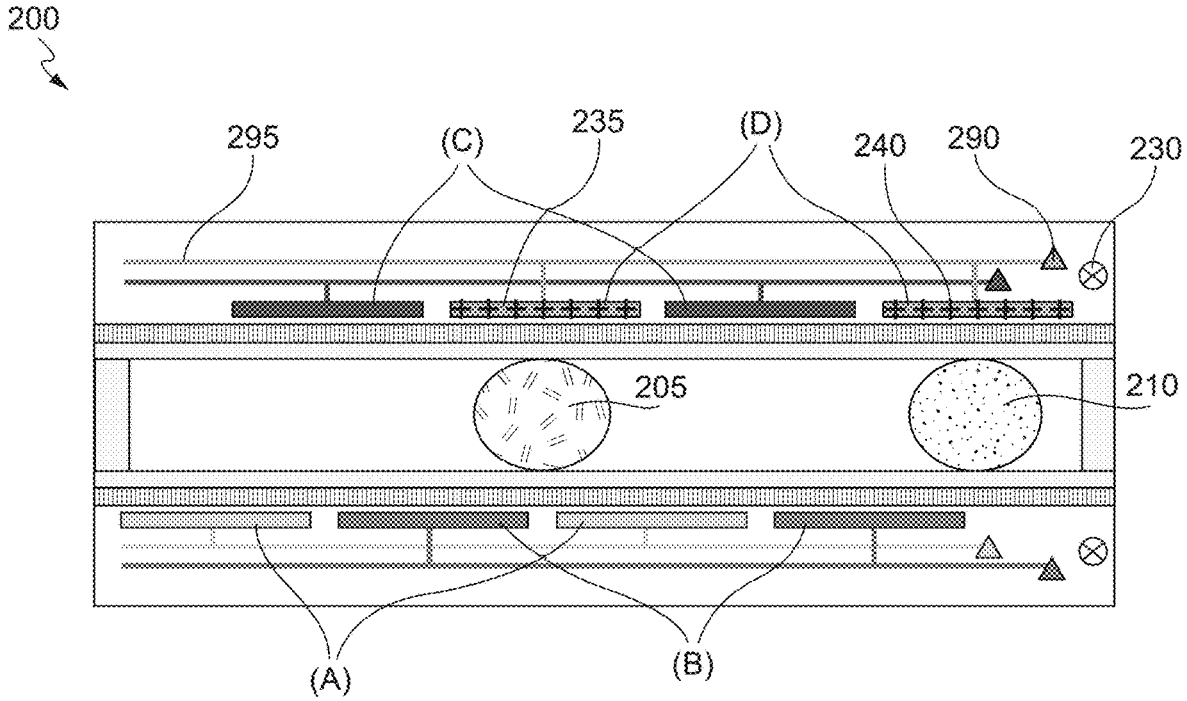

FIGS. 2A-2D show modified cross-sectional views of a digital microfluidic system 200 for manipulation of droplet(s) in accordance with various aspects of the present invention. In various embodiments, digital microfluidic system 200 includes groups of electrodes (A), (B), (C), (D) as described with respect to FIG. 1. As shown in FIG. 2A, individual droplets 205, 210 are set on their initial positions over electrodes 215 and 220, respectively. For example, single actuation point 225 (e.g., a control electrode) may be controlled via control circuitry 230 to apply electric voltage via wiring bus 231 to the group of electrodes (A) such that the group of electrodes (A) are activated (denoted by the "++++++") and the droplets 205, 210 are set on their initial positions over electrodes 215 and 220, respectively. Subsequently via activation of groups of electrodes (B), (C), (D), droplets 205, 210 may be conveyed or moved from their initial positions over electrodes 215 and 220 to final destinations under electrodes 235, 240. For example, as shown in FIG. 2B, single actuation point 245 (e.g., a control electrode) may be controlled via control circuitry 230 to apply electric voltage via wiring bus 250 to the group of electrodes (C) such that the group of electrodes (C) are activated and the droplets 205, 210 are moved to a spot under electrodes 255 and 260, respectively. As shown in FIG. 2C, single actuation point 265 (e.g., a control electrode) may be controlled via control circuitry 230 to apply electric voltage via wiring bus 270 to the group of electrodes (B) such that the group of electrodes (B) are activated and the droplets 205, 210 are moved to a spot over electrodes 275 and 280, respectively. As shown in FIG. 2D, single actuation point 290 (e.g., a control electrode) may be controlled via control circuitry 230 to apply electric voltage via wiring bus 295 to the group of electrodes (D) such that the group of electrodes (D) are activated and the droplets 205, 210 are moved to a spot under electrodes 235 and 240, respectively.

As should be understood, an applied voltage activates the droplet actuation electrodes and allows changes in the wettability of the droplets on the surface of the droplet transport layer. In order to move the droplets down the channel voltage is applied to a droplet actuation electrode adjacent to a droplet (an activated or ON electrode), and at the same time, a droplet actuation electrode just under or above the droplet is deactivated (the OFF electrodes serving as ground). By varying the electric potential along each linear array of droplet actuation electrodes, electro-wetting can be used to move the droplets along the linear array of droplet actuation electrodes.

While some embodiments are disclosed herein with respect to manipulating two droplets using four groups of electrodes bused using four separate wiring buses, this is not intended to be restrictive. In addition to two droplets, four groups of electrodes, and four wiring buses, the teachings disclosed herein can also be applied to other numbers of droplets, groups of electrodes, and busing strategies. For example, the droplet conveyance system of bused electrodes can be infinitely long with any number of groups of electrodes for manipulating any number of droplets but could also be presented in alternate geometries to enable other functionality such as droplet creation, mixing, splitting and merging. Likewise, the sequence of activation for the electrode groups is not restricted to being alternating from bottom to top and left to right. For example, the sequence of activation for the electrode groups could be based on any desired outcome. In the instance of moving the droplets from right to left, the sequence of activation for the electrode groups could be alternating from top to bottom and right to left.

Figure 3A:
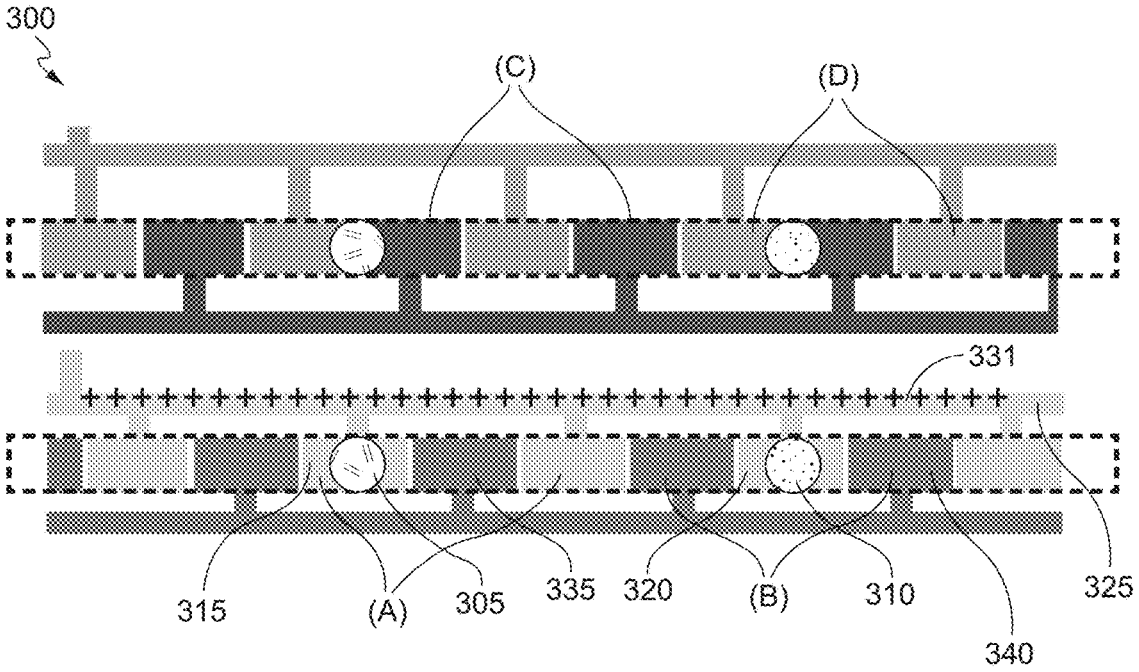
FIGS. 3A-3D show modified top-down views of a digital microfluidic system for manipulation of droplet(s) in accordance with various embodiments.
Figure 3B:
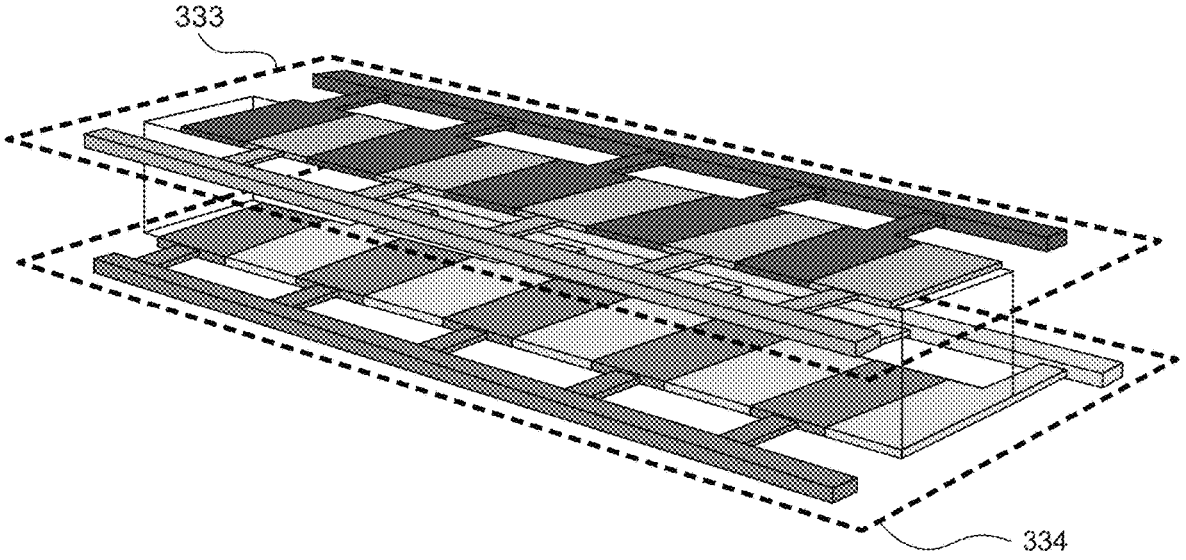
Figure 3C:
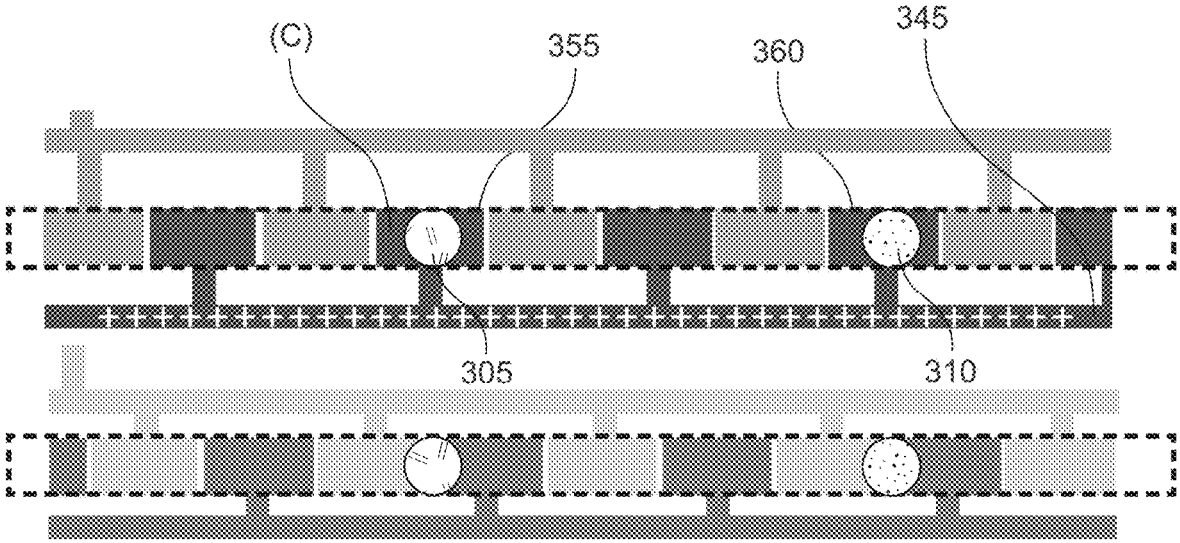
Figure 3D:
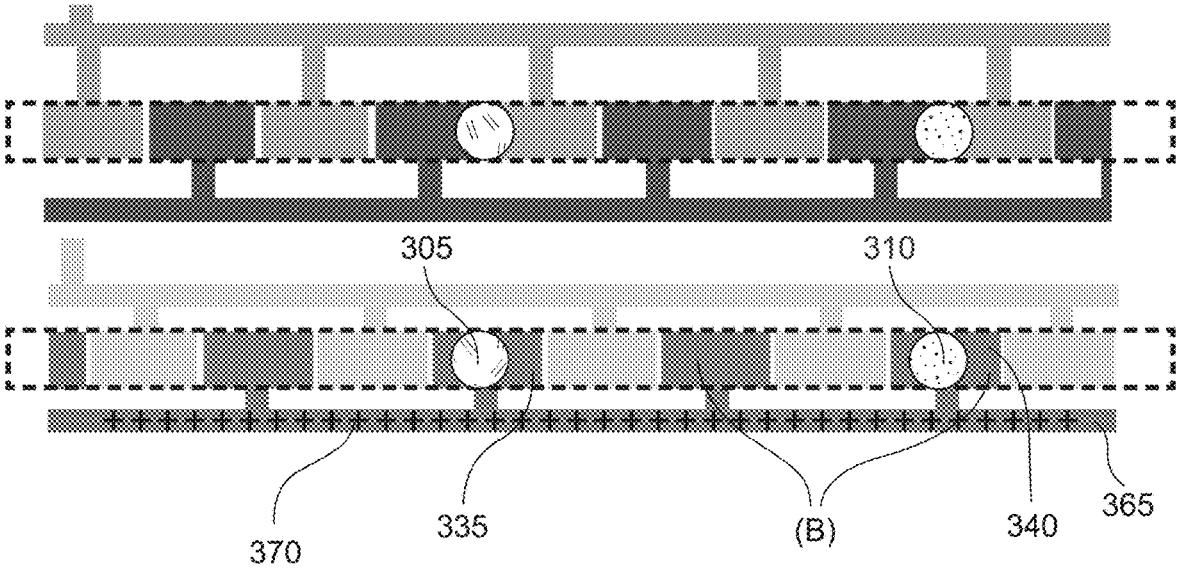

FIGS. 3A-3D show modified top-down views of a digital microfluidic system 300 for manipulation of droplet(s) in accordance with various aspects of the present invention. In various embodiments, digital microfluidic system 300 includes groups of electrodes (A), (B), (C), (D) as described with respect to FIG. 1 and FIGS. 2A-2D. As shown in FIG. 3A, individual droplets 305, 310 are set on their initial positions over electrodes 315 and 320, respectively. For example, single actuation point 325 (e.g., a control electrode) may be controlled via control circuitry to 330 apply electric voltage via wiring bus 331 to the group of electrodes (A) such that the group of electrodes (A) are activated (denoted by the "++++++") and the droplets 305, 310 are set on their initial positions over electrodes 315 and 320, respectively. Although groups of electrodes (A), (B), (C), (D) are depicted horizontal of one another on separate vertical planes, it should be understood that this depiction is merely for convenience of illustration (i.e., a modified cross-section view) and in actual implementation the groups of electrodes (A), (D) share a vertical plane 333 and the groups of electrodes (B), (C) share a vertical plane 334 (as shown in FIG. 3B). Subsequently via activation of groups of electrodes (B), (C), droplets 305, 310 may be conveyed or moved from their initial positions over electrodes 315 and 320 to final destinations over electrodes 335, 340. For example, as shown in FIG. 3C, single actuation point 345 (e.g., a control electrode) may be controlled via control circuitry to apply electric voltage via wiring bus 350 to the group of electrodes (C) such that the group of electrodes (C) are activated and the droplets 305, 310 are moved to a spot under electrodes 355 and 360, respectively. As shown in FIG. 3D, single actuation point 365 (e.g., a control electrode) may be controlled via control circuitry to apply electric voltage via wiring bus 370 to the group of electrodes (B) such that the group of electrodes (B) are activated and the droplets 305, 310 are moved to a spot over electrodes 335 and 340, respectively.

Figure 4:
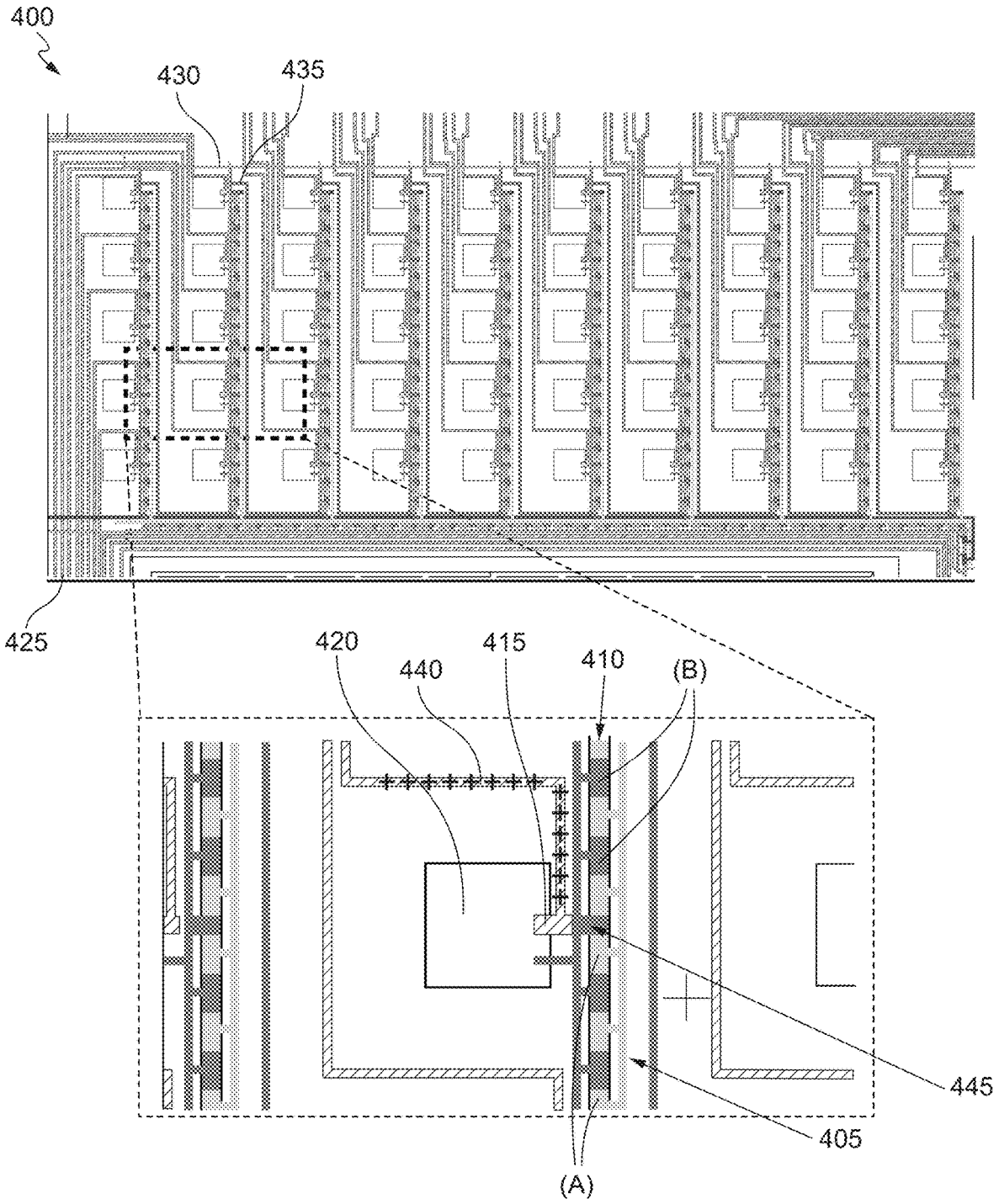
FIG. 4 shows a digital microfluidic system comprising bused droplet actuation electrodes integrated with individually addressable droplet actuation electrodes in accordance with various embodiments.

FIG. 4 shows a digital microfluidic system 400 comprising bused droplet actuation electrodes integrated with individually addressable droplet actuation electrodes in accordance with various aspects of the present invention. In various embodiments, digital microfluidic system 400 includes bused droplet actuation electrodes 405 having groups of electrodes (A) and (B) over channel 410 (as should be understood additional groups of electrodes bused together may be disposed above and/or below the channel 410 but are not shown here merely for convenience of illustration). Digital microfluidic system 400 further includes individually addressable electrode 415 disposed near (above and/or under) reservoir 420. The individually addressable electrode 415 may be activated via individual actuation points 425, whereas the groups of electrode (A), (B) may be activated by single actuation points 430, 435, respectively. For example, individual actuation points 425 (e.g., a control electrode) may be controlled via control circuitry to apply electric voltage via wiring bus 440 to the individually addressable electrode 415 such that the individually addressable electrode 415 is activated (denoted by the "++++++") and a droplet is dispensed from the reservoir 420 into dispensing region 445 of the channel 410. Subsequently, as discussed previously with respect to FIGS. 2A-2D and 3A-3D, via activation of groups of electrodes (A), (B), the dispensed droplet may be conveyed or moved from dispensing region 445 through the channel 410 to a final destination. Advantageously, the individually addressable droplet actuation electrode 415 may be integrated with the bused droplet actuation electrodes 405 to allow programmable or on-demand droplet manipulation.

Figure 5A:
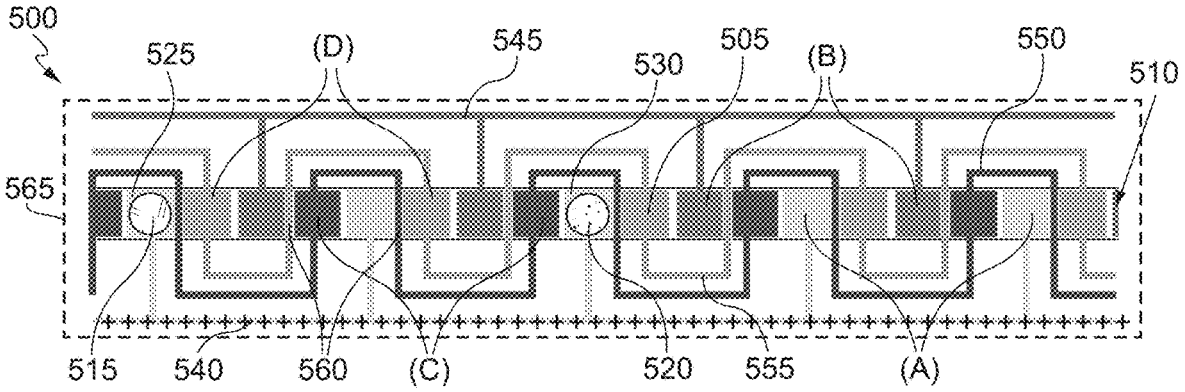
FIGS. 5A-5C show a digital microfluidic system comprising bused droplet actuation electrodes formed in a same horizontal wiring layer in accordance with various embodiments.
Figure 5B:
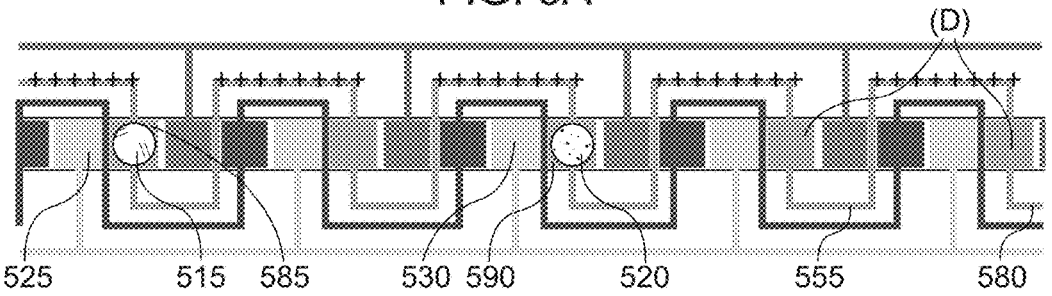
Figure 5C:
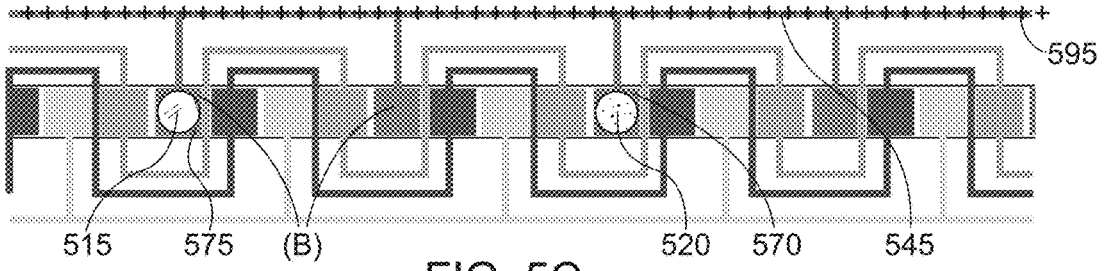

FIGS. 5A-5C show a digital microfluidic system 500 comprising bused droplet actuation electrodes formed in a same horizontal wiring layer in accordance with various aspects of the present invention. In various embodiments, digital microfluidic system 500 includes bused droplet actuation electrodes 505 having groups of electrodes (A), (B), (C) and (D) below channel 510 (as should be understood additional groups of electrodes bused together may be disposed above and/or below the channel 510 but are not shown here merely for convenience of illustration). As shown in FIG. 5A, individual droplets 515, 520 are set on their initial positions over electrodes 525 and 530, respectively. For example, single actuation point 535 (e.g., a control electrode) may be controlled via control circuitry to apply electric voltage via wiring bus 540 to the group of electrodes (A) such that the group of electrodes (A) are activated (denoted by the "++++++") and the droplets 515, 520 are set on their initial positions over electrodes 525 and 530, respectively. As shown In FIGS. 5A-5C, the group of electrodes (A) and (B) include parallel running wiring lines 540 and 545, while the group of electrodes (C) and (D) include snaking wiring lines 550 and 555. In particular, the wiring lines 540 and 545 remain on a single side of the channel 510 connecting groups of electrodes, while the wiring lines 550 and 555 snake from side to side of the channel 510 passing through spaces 560 between various droplet actuation electrodes 505. The illustrated wiring pattern for wiring lines 540, 545, 550 and 555 allows for the groups of electrodes (A), (B), (C) and (D) to be formed in a same horizontal wiring layer 565.

Subsequently via activation of groups of electrodes (B), (C), droplets 515, 520 may be conveyed or moved from their initial positions over electrodes 525 and 530 to final destinations over electrodes 570, 575. For example, as shown in FIG. 5B, single actuation point 580 (e.g., a control electrode) may be controlled via control circuitry to apply electric voltage via wiring bus 555 to the group of electrodes (D) such that the group of electrodes (D) are activated and the droplets 515, 520 are moved to a spot over electrodes 585 and 590, respectively. As shown in FIG. 5C, single actuation point 595 (e.g., a control electrode) may be controlled via control circuitry to apply electric voltage via wiring bus 545 to the group of electrodes (B) such that the group of electrodes (B) are activated and the droplets 515, 520 are moved to a spot over electrodes 570 and 575, respectively.

Figure 6:
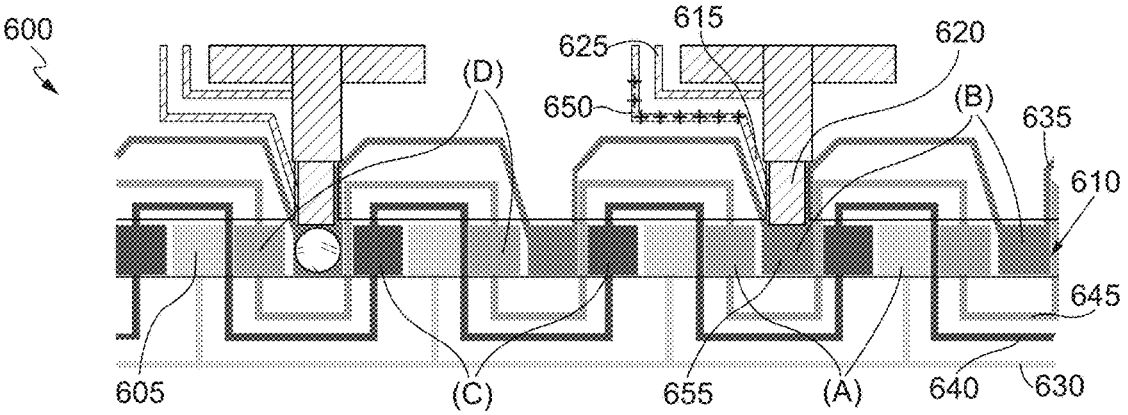
FIG. 6 shows a digital microfluidic system comprising bused droplet actuation electrodes formed in a same horizontal wiring layer and integrated with individually addressable droplet actuation electrodes in accordance with various embodiments.
Figure 8A:
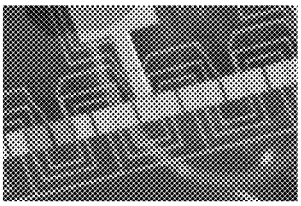
FIGS. 8A-8G are images of droplet conveyance along a channel by activation of bused droplet actuation electrodes formed in a same horizontal wiring layer in accordance with various embodiments.
Figure 8B:
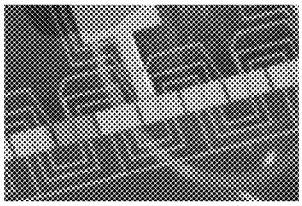
Figure 8C:
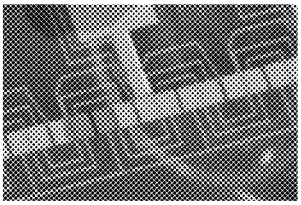
Figure 8D:
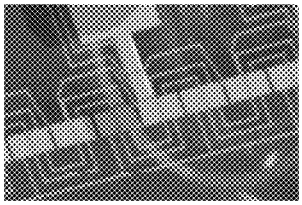
Figure 8E:
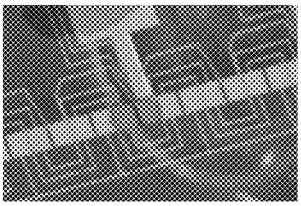
Figure 8F:
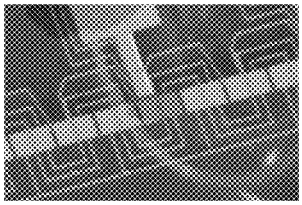
Figure 8G:
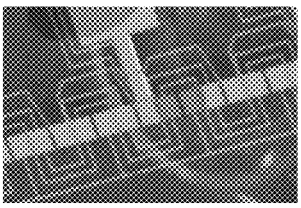

FIG. 6 shows a digital microfluidic system 600 comprising bused droplet actuation electrodes formed in a same horizontal wiring layer and integrated with individually addressable droplet actuation electrodes in accordance with various aspects of the present invention. In various embodiments, digital microfluidic system 600 includes bused droplet actuation electrodes 605 having groups of electrodes (A), (B), (C) and (D) below channel 610 (as should be understood additional groups of electrodes bused together may be disposed above and/or below the channel 610 but are not shown here merely for convenience of illustration). Digital microfluidic system 600 further includes individually addressable electrode 615 disposed near (above and/or under) reservoir 620. The individually addressable electrode 615 may be activated via individual actuation points 625, whereas the groups of electrodes (A), (B), (C), (D) may be activated by single actuation points 630, 635, 640, 645, respectively. For example, individual actuation points 625 (e.g., a control electrode) may be controlled via control circuitry to apply electric voltage via wiring bus 650 to the individually addressable electrode 615 such that the individually addressable electrode 615 is activated (denoted by the "++++++") and a droplet is dispensed from the reservoir 620 into dispensing region 655 of the channel 610. Subsequently, as discussed previously with respect to FIGS. 5A-5C, via activation of groups of electrodes (A), (B), (C), (D) the dispensed droplet may be conveyed or moved from dispensing region 655 through the channel 610 to a final destination.

FIGS. 7A-7P show different droplet manipulation techniques provided by a digital microfluidic system (e.g., digital microfluidic system 600 described with respect to FIG. 6) in accordance with various aspects of the present invention. In particular, FIGS. 7A-7D illustrate a droplet introduction technique that includes activating individually addressable electrodes 705 and 710 with groups of electrodes (D) and (B), respectively, such that a droplet 715 can be conveyed through a reservoir 720 and introduced into a channel 725 at region 730. Thereafter, the droplet 715 may be conveyed along the channel 725 by activating group of electrodes (C) and subsequently group of electrodes (A). FIGS. 7E-7H illustrate a droplet collection technique that includes activating group of electrodes (A) and subsequently group of electrodes (D) to convey the droplet 715 along channel 725 to region 730. Thereafter, individually addressable electrodes 710 and 705 may be activated with groups of electrodes (B) and (C), respectively, to draw the droplet 715 into the reservoir 720. FIGS. 7I-7L illustrate a droplet merging technique that includes activating group of electrodes (A) and subsequently group of electrodes (D) to convey the droplet 715 along channel 725 to region 730, while at the same time activating individually addressable electrode 710 to hold an additional droplet 735 (comprising the same or different constituents as droplet 715) within the region 730. Thereafter, the droplet 715 may be merged with additional droplet 735 at region 730 by activating group of electrodes (B), while at the same time activating individually addressable electrode 710. Thereafter, the merged droplet 715, 735 may be conveyed along the channel 725 by activating group of electrodes (C). FIGS. 7M-7P illustrate a droplet splitting technique that includes activating group of electrodes (A), (D), and (B) (and optionally individually addressable electrode 710) to convey a merged droplet 715, 735 along channel 725 to region 730. Thereafter, the merged droplet 715, 735 may be split at region 730 by activating group of electrodes (B), while at the same time activating individually addressable electrode 710. Thereafter, the merged droplet 715, 735 may be split at region 730 by activating individually addressable electrode 705 to draw the droplet 715 into the reservoir 720 and by activating group of electrodes (C) to convey additional droplet 735 along channel 725. Thereafter, the additional droplet 735 may be conveyed along the channel 725 by activating group of electrodes (A).

Figure 9A:
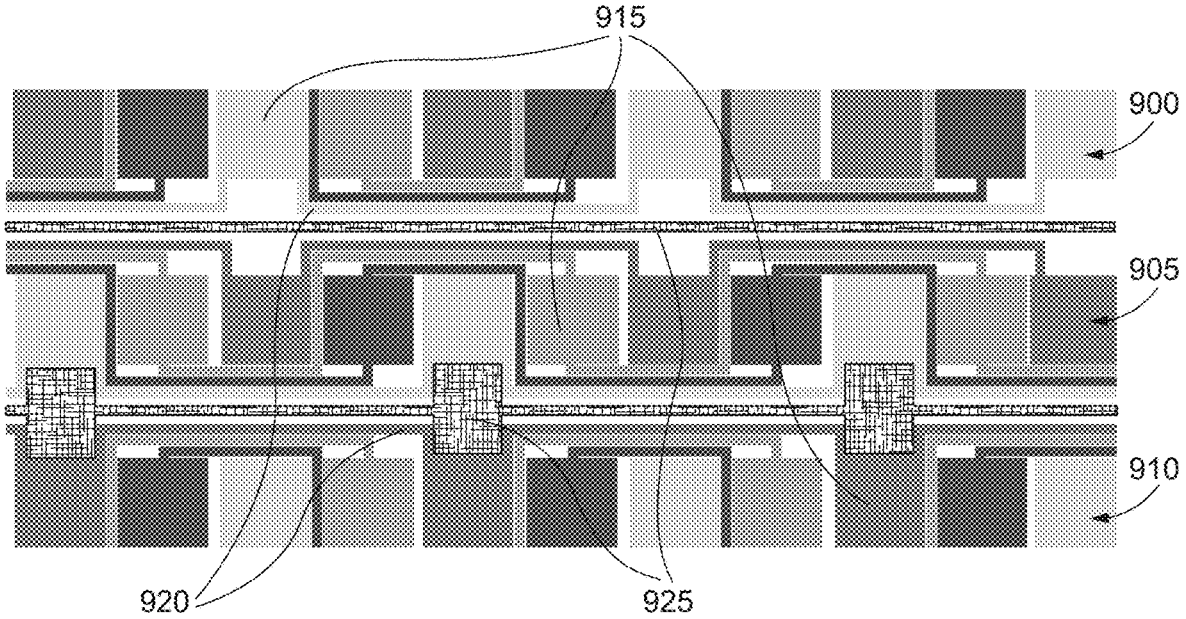
FIGS. 9A and 9B show wiring layer schematics for bused droplet actuation electrodes formed in a same horizontal wiring layer in accordance with various embodiments.
Figure 9B:
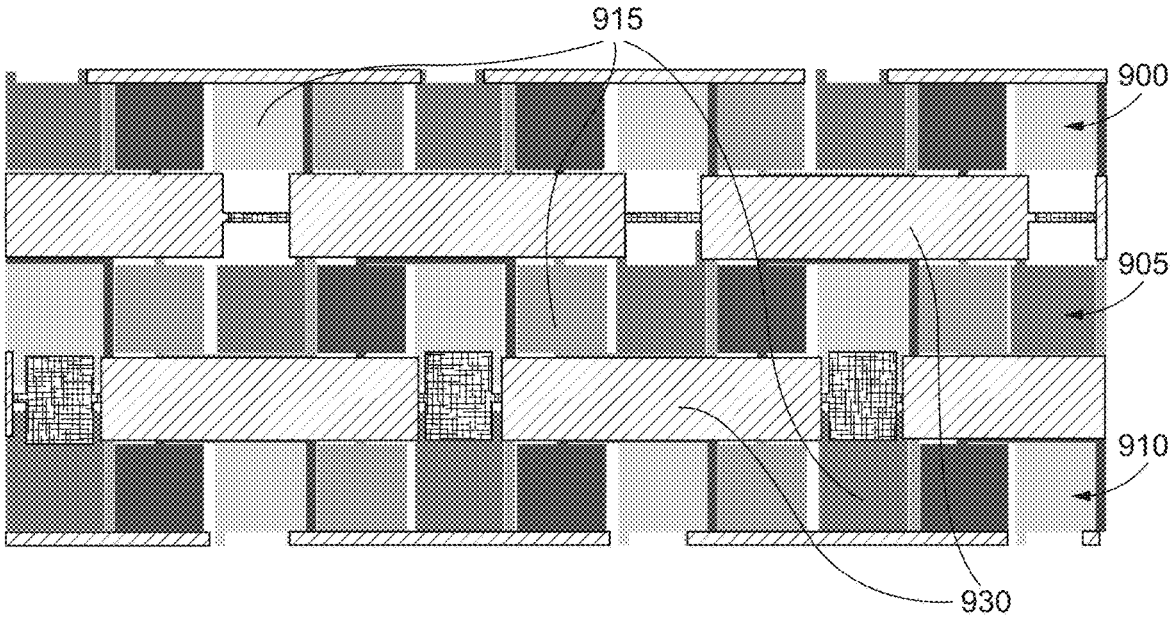
Figure 10A:
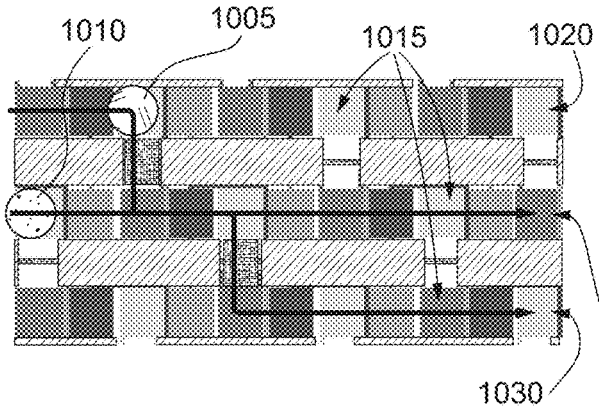
FIGS. 10A-H show different droplet manipulation techniques provided by a digital microfluidic system in accordance with various embodiments.
Figure 10E:
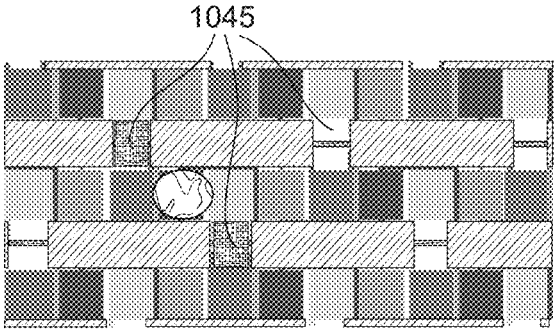
Figure 10B:
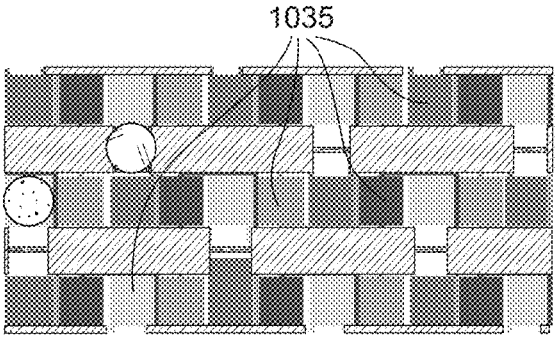
Figure 10F:
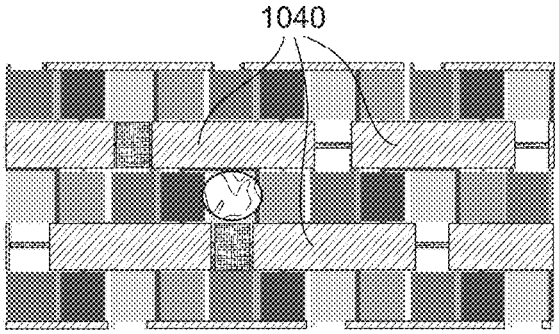
Figure 10C:
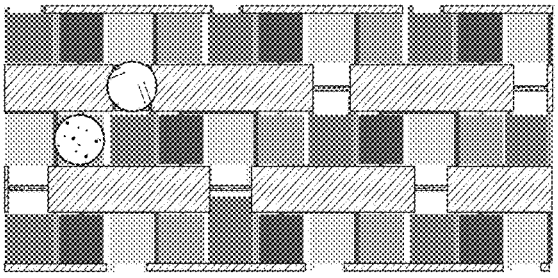
Figure 10G:
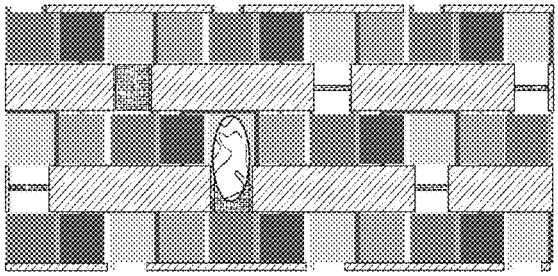
Figure 10D:
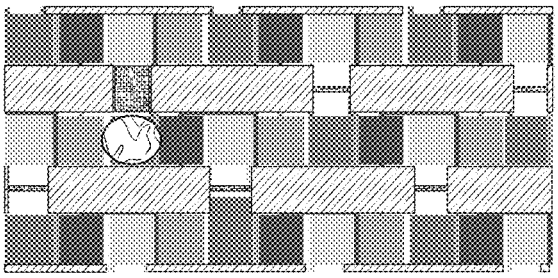
Figure 10H:
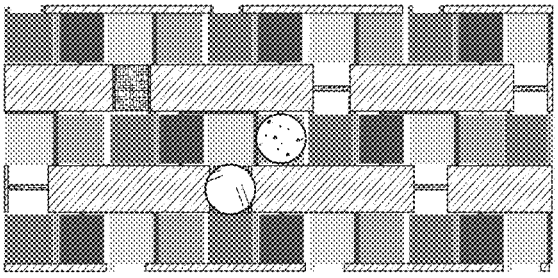

FIGS. 8A-8G are images of droplet conveyance along a channel 805 by activation of bused droplet actuation electrodes 810 formed in a same horizontal wiring layer 815 in accordance with various aspects of the present invention. FIGS. 9A and 9B show wiring layer schematics for bused droplet actuation electrodes formed in a same horizontal wiring layer in accordance with various aspects of the present invention. For example, FIG. 9A shows multiple stacked digital microfluidic systems 900, 905, 910 comprising multiple bused droplet actuation electrodes 915 formed in a same horizontal wiring layer 920, and bridging electrodes 925 formed between the stacked digital microfluidic systems 900, 905, 910. The bridging electrodes 925 may be turned ON or OFF (FIG. 9A shows the top row of bridging electrodes turned OFF) and the bottom row of bridging electrodes turned ON) to manipulate droplets between the stacked digital microfluidic systems 900, 905, 910. FIG. 9B shows multiple stacked digital microfluidic systems 900, 905, 910 comprising multiple bused droplet actuation electrodes 915 formed in a same horizontal wiring layer (not shown), and channel walls 930 formed between the stacked digital microfluidic systems 900, 905, 910. The channel walls 930 may be utilized to provide droplet confinement to actuated groups of electrodes in each of the digital microfluidic systems 900, 905, 910. FIGS. 10A-H show different droplet manipulation techniques provided by a digital microfluidic system (e.g., digital microfluidic system 900, 905, 910 described with respect to FIGS. 9A and 9B) in accordance with various aspects of the present invention. As illustrated, the droplets 1005 and 1010 may be conveyed along channels 1015 within the digital microfluidic systems 1020, 1025, 1030 (conveyed in a manner similarly described with respect to FIGS. 5A-5C and FIGS. 7A-7P) using multiple bused droplet actuation electrodes 1035. The channels 1015 may be isolated from one another using channel walls 1040. Bridging electrodes 1045 can be used (e.g., activated to ON) to pull the droplets 1005 and 1010 across the digital microfluidic systems 1020, 1025, 1030. Moreover, the bridging electrodes 1045 may be used in conjunction with the multiple bused droplet actuation electrodes 1035 to merge or split the droplets 1005 and 1010.

III. Methods For Fabricating Digital Microfluidic Devices and Systems

FIGS. 11A-11G show structures and respective processing steps for fabricating a digital microfluidic system 1100 (e.g., as described with respect to FIG. 1) in accordance with various aspects of the invention. It should be understood by those of skill in the art that the digital microfluidic system can be manufactured in a number of ways using a number of different tools. In general, however, the methodologies and tools used to form the structures of the various embodiments can be adopted from integrated circuit (IC) technology. For example, the structures of the various embodiments, e.g., electrodes, wiring layers, vias, bond/contact pads, etc., may be built on a substrate and realized in films of materials patterned by photolithographic processes. In particular, the fabrication of various structures described herein may typically use three basic building blocks: (i) deposition of films of material on a substrate and/or previous film(s), (ii) applying a patterned mask on top of the film(s) by photolithographic imaging, and (iii) etching the film(s) selectively to the mask.

As used herein, the term "depositing" may include any known or later developed techniques appropriate for the material to be deposited including but not limited to, for example: chemical vapor deposition (CVD), low-pressure CVD (LPCVD), plasma-enhanced CVD (PECVD), semi-atmosphere CVD (SACVD) and high density plasma CVD (HDPCVD), rapid thermal CVD (RTCVD), ultra-high vacuum CVD (UHVCVD), limited reaction processing CVD (LRPCVD), metalorganic CVD (MOCVD), sputtering deposition, screen printing, ion beam deposition, electron beam deposition, laser assisted deposition, thermal oxidation, thermal nitridation, spin-on methods, physical vapor deposition (PVD), atomic layer deposition (ALD), chemical oxidation, molecular beam epitaxy (MBE), plating (e.g., electroplating), or evaporation.

As used herein, the term "etching" may include any known or later developed techniques appropriate for the material to be etched including but not limited to, for example: machine drilling, chemical etching, particle blasting, laser drilling, wet etching, dry etching, and plasma etching.

Figure 11A:
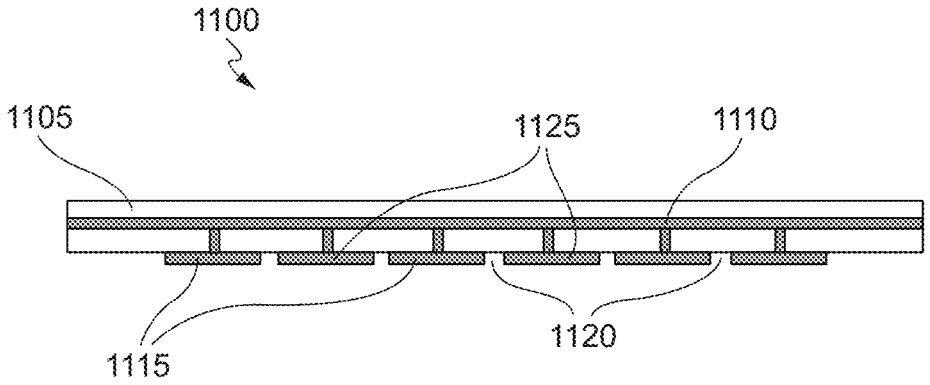
FIGS. 11A-11G show cross-sectional side views illustrating a method of fabricating a digital microfluidic system in accordance with various embodiments.

FIG. 11A shows a top plate 1100 comprising a substrate 1105, a wiring layer 1110 and multiple bused droplet actuation electrodes 1115. The substrate 1105 may be a printed circuit board (PCB), a flexible circuit board, a glass substrate, a fused silica substrate, polydimethylsiloxane (PDMS), a silicon substrate, a three dimensional printed substrate, a paper substrate, a polymer substrate or any combination thereof. The substrate 1105 may be thinned to a desired thickness by planarization, grinding, etching, oxidation followed by oxide etch, or any combination thereof. This process can be repeated to achieve a desired thickness for the substrate 1105. In some embodiments, the substrate 1105 may have a thickness from 1.0 μm to 10.0 μm. In other embodiments, the substrate 1105 may have a thickness from 10.0 μm to 3 μcm.

The wiring layer 1110 and multiple bused droplet actuation electrodes 1115 may be formed within and on at least a portion of the substrate 1105 as shown in FIG. 11A, for example. In some embodiments, forming the wiring layer 1110 and multiple bused droplet actuation electrodes 1115 may include using conventional processes. For example, a conductive material may be deposited on the substrate 1105. The conductive material may be chromium (Cr), copper (Cu), gold (Au), silver (Ag), titanium (Ti), or platinum (Pt), or alloys thereof such as gold/chromium (Au/Cr) or Titanium/Platinum (Ti/Pt), for example. Once the conductive material is deposited, the conductive material may be patterned using conventional lithography and etching processes to form the wiring layer 1110 and a pattern of electrodes 1115. In various embodiments, the pattern of electrodes 1115 may include each electrode 1115 spaced apart from one another via a portion or region 1115 of the substrate 1105. It should be understood by those of skill in the art that different patterns are also contemplated by the present invention. In some embodiments, the wiring layer 1110 may be connected to alternating electrodes 1115 and one or more additional wiring layers (not shown) may be connected to other electrodes 1125. In certain embodiments, the wiring layer 1110 and one or more additional wiring layers are on a same horizontal plane within the substrate 1105 (as shown in FIGS. 3A-3D) running parallel to one another such that electrodes can be formed using 2D fabrication processes. Each wiring layer 1110 provides an electrical connection between its respective group of electrodes 1115 and control circuitry so that each group of electrodes 1115 can be directly and independently electrically actuated.

Figure 11B:
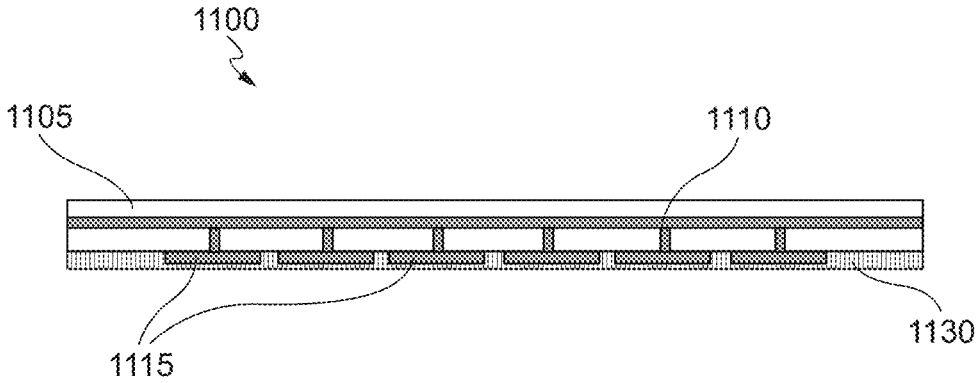

FIG. 11B shows a top plate 1100 comprising a substrate 1105, a wiring layer 1110, multiple bused droplet actuation electrodes 1115, and a dielectric layer 1130. The dielectric layer 1130 may be formed over at least a portion of the substrate 1105 and/or electrodes 1115. In some embodiments, forming the dielectric layer 1130 may include using conventional processes. For example, a dielectric material may be blanket deposited on the substrate 1105 and/or electrodes 1115. The dielectric material may be parylene C, parylene AF4, polyimide, polytetrafluoroethylene (PTFE), polydimethylsiloxane (PDMS), silicon dioxide, silicon nitride, photopolymers, polylactic acid, or acrylonitrile butadiene styrene, for example. Once the dielectric material is deposited, the dielectric material may be patterned using conventional lithography and etching processes to form the dielectric layer 1130 as shown in FIG. 11B, for example.

Figure 11C:
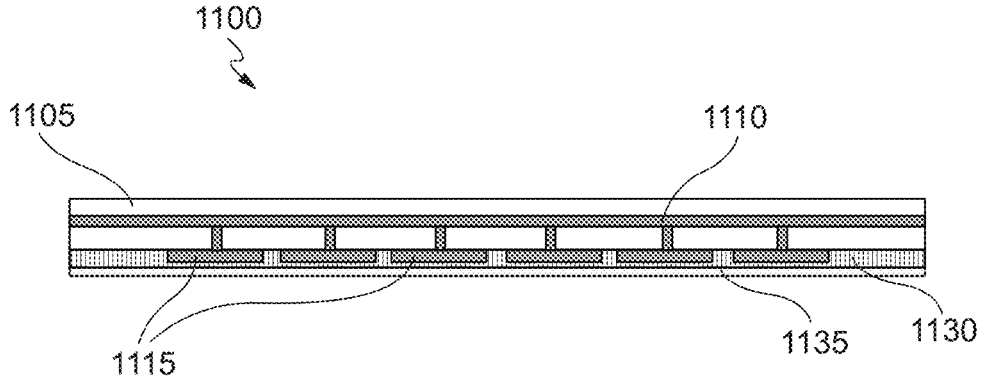

Optionally, FIG. 11C shows a top plate 1100 comprising a substrate 1105, a wiring layer 1110, multiple bused droplet actuation electrodes 1115, a dielectric layer 1130, and a hydrophobic layer 1135. The hydrophobic layer 1135 may be formed over at least a portion of the dielectric layer 1130. In some embodiments, forming the hydrophobic layer 1135 may include using conventional processes. For example, a hydrophobic material may be blanket deposited on the dielectric layer 1130. The hydrophobic material may be Teflon™ AF, Cytop®, Rain-X®, Aquapel® superhydrophobic nanostructures or parylene AF4 for example. Once the hydrophobic material is deposited, the hydrophobic material may be patterned using conventional lithography and etching processes to form the hydrophobic layer 1135 as shown in FIG. 11C, for example.

Figure 11D:
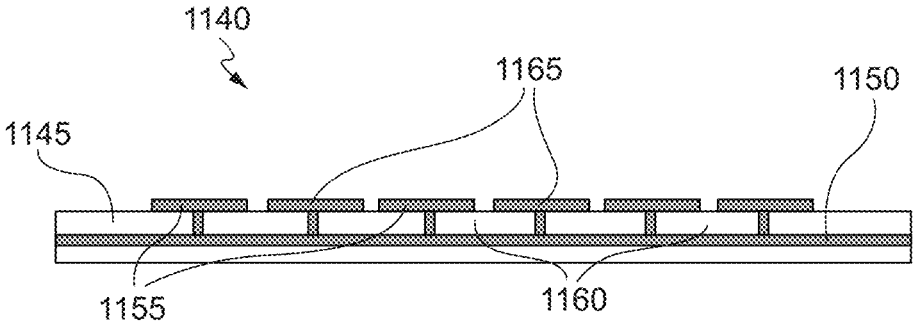

FIG. 11D shows a bottom plate 1140 comprising a substrate 1145, a wiring layer 1150 and multiple bused droplet actuation electrodes 1155. The substrate 1145 may be glass, organic or inorganic polymers (e.g., liquid crystal polymers or polyimide), printed circuit boards (PCBs), paper, etc. The substrate 1145 may be thinned to a desired thickness by planarization, grinding, etching, oxidation followed by oxide etch, or any combination thereof. This process can be repeated to achieve a desired thickness for the substrate 1145. In some embodiments, the substrate 1145 may have a thickness from 1.0 μm to 24.0 μm. In other embodiments, the substrate 1145 may have a thickness from 4.0 μm to 15.0 μm.

The wiring layer 1150 and multiple bused droplet actuation electrodes 1155 may be formed within and on at least a portion of the substrate 1145 as shown in FIG. 11D, for example. In some embodiments, forming the wiring layer 1150 and multiple bused droplet actuation electrodes 1155 may include using conventional processes. For example, a conductive material may be deposited on the substrate 1145. The conductive material may be chromium (Cr), copper (Cu), gold (Au), silver (Ag), titanium (Ti), or platinum (Pt), or alloys thereof such as gold/chromium (Au/Cr) or Titanium/Platinum (Ti/Pt), for example. Once the conductive material is deposited, the conductive material may be patterned using conventional lithography and etching processes to form the wiring layer 1150 and a pattern of electrodes 1155. In various embodiments, the pattern of electrodes 1155 may include each electrode 1155 spaced apart from one another via a portion or region 1160 of the substrate 1145. It should be understood by those of skill in the art that different patterns are also contemplated by the present invention. In some embodiments, the wiring layer 1150 may be connected to alternating electrodes 1155 and one or more additional wiring layers (not shown) may be connected to other electrodes 1165. In certain embodiments, the wiring layer 1150 and one or more additional wiring layers are on a same horizontal plane within the substrate 1145 (as shown in FIGS. 3A-3D) running parallel to one another such that electrodes can be formed using 2D fabrication processes. Each wiring layer 1150 provides an electrical connection between its respective group of electrodes 1155 and control circuitry so that each group of electrodes 1155 can be directly and independently electrically actuated.

Figure 11E:
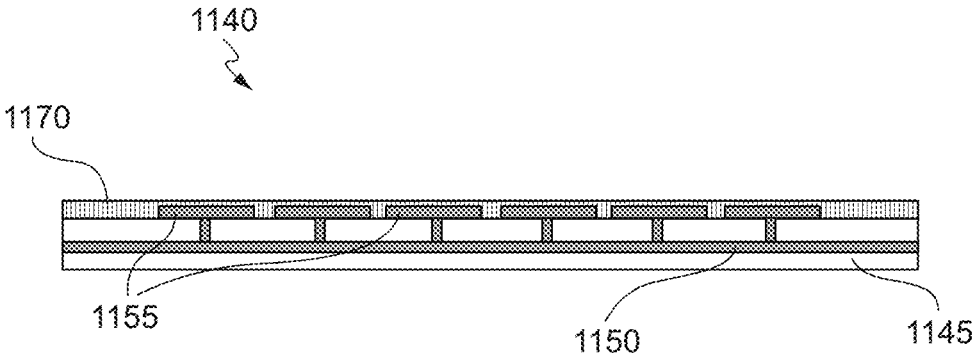

FIG. 11E shows a bottom plate 1140 comprising a substrate 1145, a wiring layer 1150, multiple bused droplet actuation electrodes 1155, and a dielectric layer 1170. The dielectric layer 1170 may be formed over at least a portion of the substrate 1145 and/or electrodes 1155. In some embodiments, forming the dielectric layer 1170 may include using conventional processes. For example, a dielectric material may be blanket deposited on the substrate 1145 and/or electrodes 1155. The dielectric material may be parylene C, parylene AF4, polyimide, polytetrafluoroethylene (PTFE), polydimethylsiloxane (PDMS), silicon dioxide, silicon nitride, photopolymers, polylactic acid, or acrylonitrile butadiene styrene, for example. Once the dielectric material is deposited, the dielectric material may be patterned using conventional lithography and etching processes to form the dielectric layer 1170 as shown in FIG. 11E, for example.

Figure 11F:
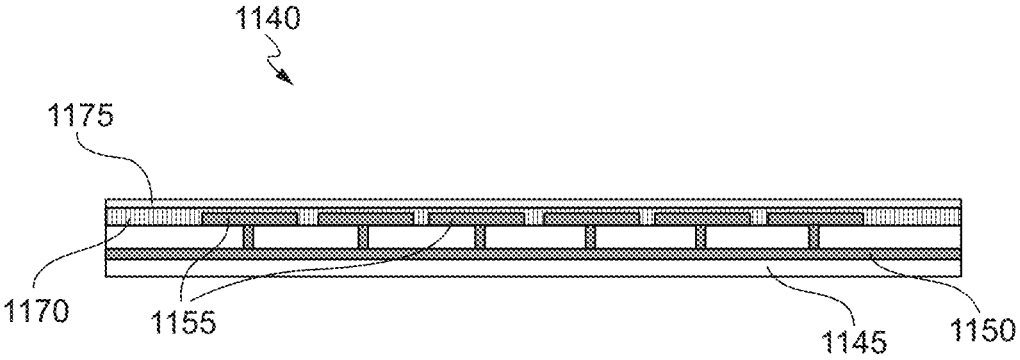

Optionally, FIG. 11F shows a bottom plate 1140 comprising a substrate 1145, a wiring layer 1150, multiple bused droplet actuation electrodes 1155, a dielectric layer 1170, and a hydrophobic layer 1175. The hydrophobic layer 1175 may be formed over at least a portion of the dielectric layer 1170. In some embodiments, forming the hydrophobic layer 1175 may include using conventional processes. For example, a hydrophobic material may be blanket deposited on the dielectric layer 1170. The hydrophobic material may be Teflon™ AF, Cytop®, Rain-X®, Aquapel® superhydrophobic nanostructures or parylene AF4 for example. Once the hydrophobic material is deposited, the hydrophobic material may be patterned using conventional lithography and etching processes to form the hydrophobic layer 1175 as shown in FIG. 11F, for example.

Figure 11G:
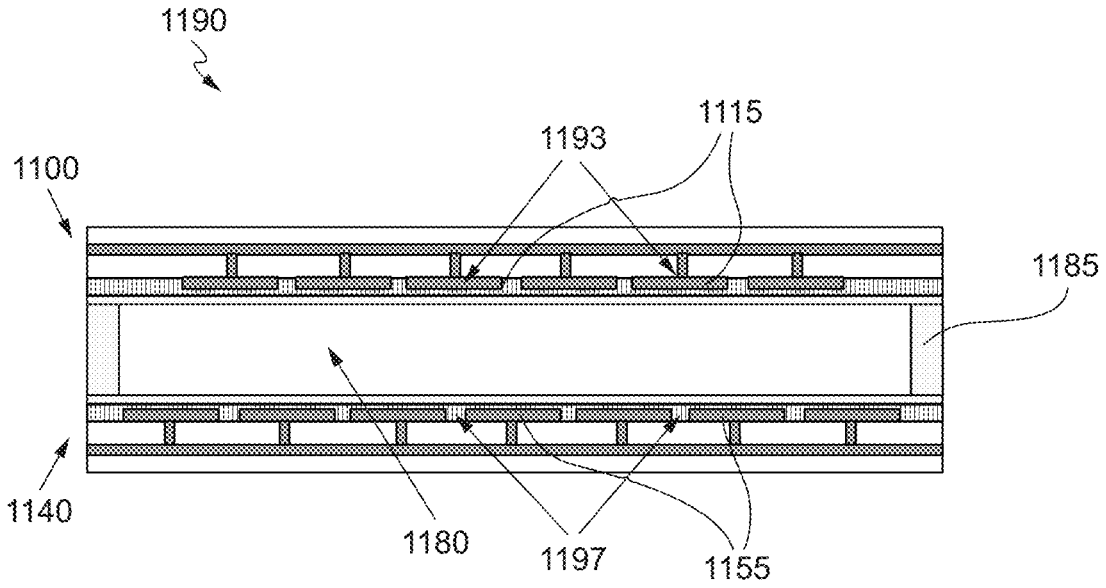

Following formation of the top plate 1100 and the bottom plate 1140, a one or more channels 1180 may be formed between the top plate 1100 and the bottom plate 1140. In various embodiments, spacers 1185 may be deposited on the bottom plate 1140 to create the one or more channels 1180. In some embodiments, forming the spacers 1185 may include using conventional processes. For example, a spacer material may be blanket deposited on the top plate 1140. The spacer material may be polymers, glass, tape, SU-8 photoresist, polydimethylsiloxane (PDMS), polyethylene terephthalate (PET), poly(methyl methacrylate) (PMMA), polystyrene (PS), Cyclic Olefin Copolymer (COC), for example. Once the spacer material is deposited, the spacer material may be patterned using conventional lithography and etching processes to form the spacers 1185 as shown in FIG. 11G, for example. Thereafter, the top plate 1100 can be joined with the bottom plate 1140 via the spacers 1185. In various embodiments, the joining includes laying the top plate 1100 over the bottom plate 1140 on the spacers 1185 and connecting the top plate 1100 to the top surfaces of the spacers 1185. The connecting may be accomplished using any conventional method such as the use of a permanent or temporary adhesive layer between the top layer 1100 and the spacers 1185. In certain embodiments, the group of electrodes 1115 are fabricated on top plate 1100, the group of electrodes 1155 are fabricated on bottom plate 1140, and the top plate 1100 and the bottom plate 1140 are joined such that a center 1193 of each electrode of the group of electrodes 1115 are shifted to align with open spaces 1197 between each of the electrodes of the group of electrodes 1155. The connection of the top plate 1100 to the bottom plate 1140 results in the final product of a digital microfluidic system 1190. In accordance with various aspects discussed herein, the digital microfluidic system 1190 includes an electrode bus controlled by a single actuation input and is intended to be disposable or adequate for limited use.

IV. Methods For Droplet Manipulation

Figure 12:
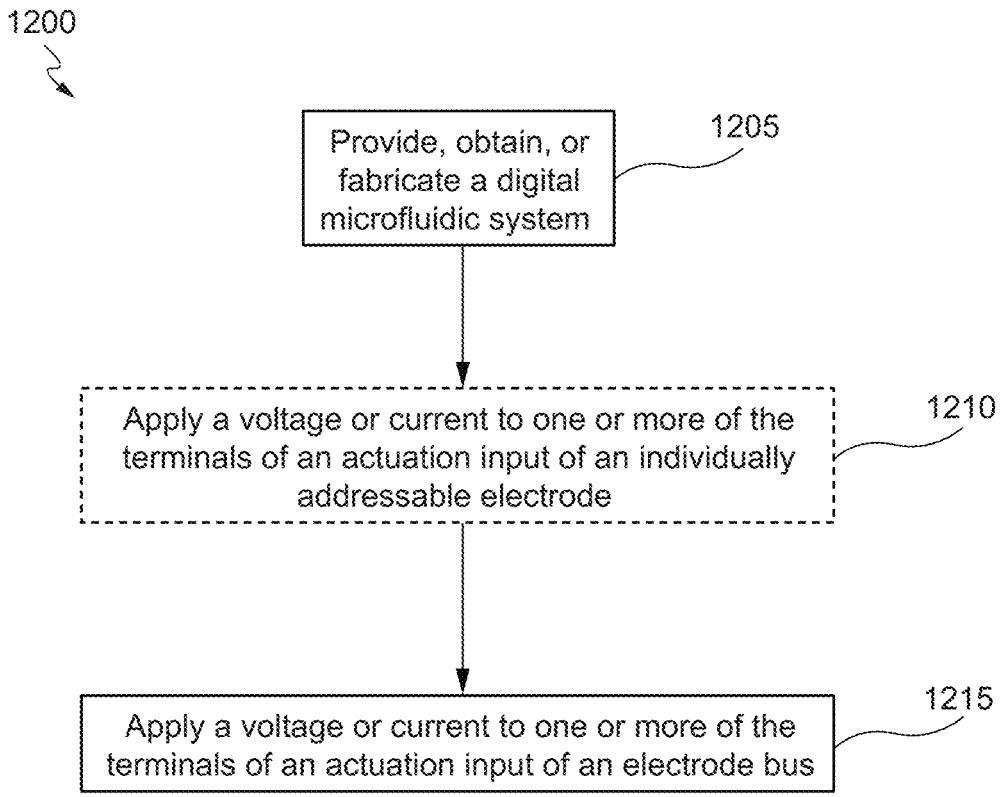
FIG. 12 shows an exemplary flow for droplet manipulation in accordance with various embodiments.

FIG. 12 depicts a simplified flowchart 1200 depicting processing performed for droplet manipulation according to embodiments of the present invention. As noted herein, the flowchart of FIG. 12 illustrate the architecture, functionality, and operation of possible implementations of systems, methods, and computer program products according to various embodiments of the present invention. In this regard, each block in the flowchart or block diagrams may represent a module, segment, or portion of code, which comprises one or more executable instructions for implementing the specified logical functions. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combination of blocks in the block diagrams and/or flowchart illustration, can be implemented by special purpose hardware-based systems that perform the specified functions or acts, or combinations of special purpose hardware and computer instructions.

At step 1205, a digital microfluidic system is provided, obtained, or fabricated in accordance with various aspects discussed herein. At optional step 1210, a voltage is applied via driving circuitry to one or more of the terminals of an actuation input (e.g., a control electrode) of an individually addressable electrode (e.g., a droplet actuation electrode disposed near (above and/or under) reservoir). The applied voltage actuates the individually addressable electrode and allows changes in wettability of a droplet on or near the individually addressable electrode. At step 1215, a voltage is applied via driving circuitry to one or more of the terminals of an actuation input (e.g., a control electrode) of an electrode bus (e.g., a wiring attached to multiple droplet actuation electrodes). The applied voltage actuates the multiple droplet actuation electrodes (group of droplet actuation electrodes) and allows changes in wettability of one or more droplets on or near the multiple droplet actuation electrodes. In various embodiments, the droplet may be manipulated under wettability differences between actuated and nonactuated electrodes in order to dispense, transport, split, and merge the droplet(s), as discussed in detail herein. For example, in order to move a droplet, a control voltage may be applied to an electrode adjacent to the droplet, and at the same time, the electrode just under the droplet is deactivated. By varying the electric potential along a linear array of electrodes comprising groups of droplet actuation electrodes bused together, electrowetting can be used to move droplets along the array of electrodes and through a channel.

While the invention has been described in detail, modifications within the spirit and scope of the invention will be readily apparent to the skilled artisan. It should be understood that aspects of the invention and portions of various embodiments and various features recited above and/or in the appended claims may be combined or interchanged either in whole or in part. In the foregoing descriptions of the various embodiments, those embodiments which refer to another embodiment may be appropriately combined with other embodiments as will be appreciated by the skilled artisan. Furthermore, the skilled artisan will appreciate that the foregoing description is by way of example only, and is not intended to limit the invention.

What is claimed is:

1. A digital microfluidic system comprising:

a substrate;

a first group of droplet actuation electrodes formed in the substrate;

a first wiring bus formed in the substrate and connected to each electrode in the first group of droplet actuation electrodes, wherein the first wiring bus is configured to transmit a first actuation signal from a first single point of actuation concurrently to the first group of droplet actuation electrodes;

a second group of droplet actuation electrodes formed in the substrate;

a second wiring bus formed in the substrate and connected to each electrode in the second group of droplet actuation electrodes, wherein the second wiring bus is configured to transmit a second actuation signal from a second single point of actuation concurrently to the second group of droplet actuation electrodes;

a third group of droplet actuation electrodes formed in the substrate;

a third wiring bus formed in the substrate and connected to each electrode in the third group of droplet actuation electrodes, wherein the third wiring bus is configured to transmit a third actuation signal from a third single point of actuation concurrently to the third group of droplet actuation electrodes;

a fourth group of droplet actuation electrodes formed in the substrate;

a fourth wiring bus formed in the substrate and connected to each electrode in the fourth group of droplet actuation electrodes, wherein the fourth wiring bus is configured to transmit a fourth actuation signal from a fourth single point of actuation concurrently to the fourth group of droplet actuation electrodes; and a dielectric layer formed over the first group of droplet actuation electrodes and the second group of droplet actuation electrodes, wherein droplet actuation electrodes from the first group, the second group, the third group, and the fourth group are alternately arrange in a linear array, wherein the first wiring bus and the second wiring bus are disposed at opposite sides of the droplet actuation electrodes within a same horizontal wiring layer of the substrate, and wherein the third wiring bus and the fourth wiring bus pass through spaces between the droplet actuation electrodes from one side of the droplet actuation electrodes to an opposite side of the droplet actuation electrodes within the same horizontal wiring layer of the substrate.

2. The digital microfluidic system of claim 1, wherein the first wiring bus and the second wiring bus run parallel to one another and are disposed within the same horizontal wiring layer of the substrate.

3. The digital microfluidic system of claim 2, further comprising a channel formed above the first group of droplet actuation electrodes and the second group of droplet actuation electrodes, wherein the first wiring bus is formed in the substrate on a first side of the channel and the second wiring bus is formed in the substrate on a second side of the channel that is opposite the first side.

4. The digital microfluidic system of claim 3, wherein the first single point of actuation is a first control electrode and the second single point of actuation is a second control electrode.

5. The digital microfluidic system of claim 3, wherein each electrode in the first group of droplet actuation electrodes is formed in an alternating pattern below the channel with each electrode in the second group of droplet actuation electrodes.

6. The digital microfluidic system of claim 1, further comprising a hydrophobic layer formed on the dielectric layer, wherein the substrate comprises a printed circuit board (PCB), a flexible circuit board, a glass substrate, a fused silica substrate, polydimethylsiloxane (PDMS), a silicon substrate, a three dimensional printed substrate, a paper substrate, a polymer substrate or any combination thereof.

7. The digital microfluidic system of claim 1, wherein the substrate is an organic polymer substrate, an inorganic substrate, a semiconductor substrate or any combination thereof.

8. The digital microfluidic system of claim 1, further comprising one or more individually addressable droplet actuation electrodes formed in the substrate, wherein each of the one or more individually addressable droplet actuation electrodes is connected to a different single point of actuation.

9. A method of droplet manipulation comprising:

obtaining a digital microfluidic system comprising: (i) a first group of droplet actuation electrodes formed in a substrate, a first wiring bus formed in the substrate and connected to each electrode in the first group of droplet actuation electrodes, and a first single point of actuation connected to the first wiring bus; (ii) a second group of droplet actuation electrodes formed in the substrate, a second wiring bus formed in the substrate and connected to each electrode in the second group of droplet actuation electrodes, and a second single point of actuation connected to the second wiring bus; (iii) a third group of droplet actuation electrodes formed in the substrate, a third wiring bus formed in the substrate and connected to each electrode in the third group of droplet actuation electrodes, and a third single point of actuation connected to the third wiring bus; and (iv) a fourth group of droplet actuation electrodes formed in the substrate, a fourth wiring bus formed in the substrate and connected to each electrode in the fourth group of droplet actuation electrodes, and a fourth single point of actuation connected to the fourth wiring bus; wherein droplet actuation electrodes from the first group, the second group, the third group, and the fourth group are alternately arrange in a linear array, wherein the first wiring bus and the second wiring bus are disposed at opposite sides of the droplet actuation electrodes within a same horizontal wiring layer of the substrate, wherein the third wiring bus and the fourth wiring bus pass through spaces between the droplet actuation electrodes from one side of the droplet actuation electrodes to an opposite side of the droplet actuation electrodes within the same horizontal wiring layer of the substrate;

concurrently actuating the first group of droplet actuation electrodes by applying a first electrical voltage to the first single point of actuation, the first electrical voltage causing a change in wettability of a droplet on or within the digital microfluidic system;

subsequently concurrently actuating the second group of droplet actuation electrodes by applying a second electrical voltage to the second single point of actuation, the second electrical voltage causing a change in wettability of the droplet on or within the digital microfluidic system;

subsequently concurrently actuating the third group of droplet actuation electrodes by applying a third electrical voltage to the third single point of actuation, the third electrical voltage causing a change in wettability of the droplet on or within the digital microfluidic system; and subsequently concurrently actuating the fourth group of droplet actuation electrodes by applying a fourth electrical voltage to the fourth single point of actuation, the fourth electrical voltage causing a change in wettability of the droplet on or within the digital microfluidic system.

10. The method of claim 9, further comprising creating droplets from a reservoir, moving droplets, dividing droplets, or combining droplets by actuating the first group of droplet actuation electrodes connected to the first single point of actuation with a signal applied to the first single point of actuation, actuating the second group of droplet actuation electrodes connected to the second single point of actuation with a signal applied to the second single point of actuation, actuating the third group of droplet actuation electrodes connected to the third single point of actuation with a signal applied to the third single point of actuation, actuating the fourth group of droplet actuation electrodes connected to the fourth single point of actuation with a signal applied to the fourth single point of actuation.

* * * * *